US006200245B1

(12) United States Patent
Dodo et al.

(10) Patent No.: US 6,200,245 B1
(45) Date of Patent: Mar. 13, 2001

(54) APPARATUS AND METHOD FOR CHANGING DIES

(75) Inventors: Yasushi Dodo, Kanagawa; Kenichi Ide, Yokohama; Shigeki Narushima, Yokosuka; Nobuhiro Tazoe; Yasuhiro Fujii, both of Yokohama; Sadakazu Masuda, Tokyo; Shuichi Yamashina, Tokyo; Shozo Ikemune, Tokyo, all of (JP)

(73) Assignees: Ishikawajima-Harima Heavy Industries Co., Ltd.; NKK Corporation, both of Tokyo (JP)

( * ) Notice: Subject to any disclaimer, the term of this patent is extended or adjusted under 35 U.S.C. 154(b) by 0 days.

(21) Appl. No.: 09/355,198

(22) PCT Filed: Nov. 10, 1998

(86) PCT No.: PCT/JP98/05063

§ 371 Date: Jul. 26, 1999

§ 102(e) Date: Jul. 26, 1999

(87) PCT Pub. No.: WO99/26737

PCT Pub. Date: Jun. 3, 1999

(30) Foreign Application Priority Data

| | | |
|---|---|---|
| Nov. 26, 1997 | (JP) | 9-324668 |
| Jan. 9, 1998 | (JP) | 10-002933 |
| Jun. 15, 1998 | (JP) | 10-166547 |

(51) Int. Cl.[7] ..... B23Q 3/155; B21B 13/18; B21D 31/06

(52) U.S. Cl. ..... 483/1; 72/446; 100/229 R; 100/918; 483/28

(58) Field of Search ..... 483/1, 16, 28, 483/29; 83/954; 72/446, 448; 100/229 R, 918; 425/186

(56) References Cited

U.S. PATENT DOCUMENTS

| | | | | |
|---|---|---|---|---|
| 3,559,522 | * | 2/1971 | Valente | 72/446 |
| 3,841,141 | * | 10/1974 | Rachwal | 100/918 |
| 4,152,978 | * | 5/1979 | Abe et al. | 72/446 |
| 4,614,108 | * | 9/1986 | Bolle et al. | 72/446 |
| 5,366,431 | * | 11/1994 | Smith et al. | 483/1 |
| 5,913,760 | * | 6/1999 | Kamada et al. | 483/1 |

FOREIGN PATENT DOCUMENTS

| | | | | |
|---|---|---|---|---|
| 0 955 104 A1 | | 11/1999 | (EP) . | |
| 1516969 | * | 3/1968 | (FR) | 100/918 |
| 46-5044 | | 2/1971 | (JP) . | |
| 55-8355 | | 1/1980 | (JP) . | |
| 57-106403 | | 7/1982 | (JP) . | |
| 57-106409 | | 7/1982 | (JP) . | |
| 59-85305 | | 5/1984 | (JP) . | |
| 59-92103 | | 5/1984 | (JP) . | |
| 63-90303 | | 4/1988 | (JP) . | |
| 2-14139 | | 1/1990 | (JP) . | |
| 2-175011 | | 7/1990 | (JP) . | |
| 4-89190 | | 3/1992 | (JP) . | |
| 06-165803 | | 6/1994 | (JP) . | |
| 11-249346 | | 9/1999 | (JP) . | |

* cited by examiner

*Primary Examiner*—William Briggs
(74) *Attorney, Agent, or Firm*—Griffin & Szipl, P.C.

(57) ABSTRACT

The die changing apparatus for a plate reduction press machine, comprises an upper die support holder 28*a* and a lower die support holder 28*b* that are arranged vertically on opposite sides of a transfer line, and support holder guide rails 31 installed on the upper die support holder and extending substantially horizontally in the lateral direction of the transfer line, and an upper die 29*a* and a lower die 29*b* are mounted on the upper and lower die support holders, respectively using the rollers onto the dies, fixing devices 30 that fix the upper and lower dies on the upper and lower die support holders, respectively, die fastening members 38 which are placed on each side of the upper and lower dies, opposite each other in such a manner that they can be fastened to both dies, and a die changing mechanism that can move one of the die fastening members in a direction perpendicular to the transfer line.

12 Claims, 16 Drawing Sheets

APPARATUS AND METHOD FOR CHANGING DIES

BACKGROUND OF THE INVENTION

1. Technical Field of the Invention

This invention relates to apparatus and method for changing dies, and a press dies for a plate reduction press machine.

2. Prior Art

1. FIGS. 1 and 2 show an example of a conventional plate reduction press machine; the machine comprises a frame 1 installed at a predetermined location on a transfer line S, provided with guide columns 3 such that the material to be pressed 2 can be moved inside the frame 1, a lower die holder 4 fixed substantially horizontally at the lower ends of the guide columns 3, an upper die holder 5 connected to the guide columns 3 so that it can be freely raised and lowered in opposition to the lower die holder 4 across the transfer line S, a crank shaft (not illustrated) located above the die holder 5, extending substantially horizontally in a direction orthogonal to the transfer line, and supported on the frame 1 by bearings on the non-eccentric portions, and a lower die 8 and an upper die 9 mounted on the lower die holder 4 and the upper die holder 5, respectively, facing each other, on opposite sides of the transfer line S.

The lower die holder 4 is provided with a dovetail groove 10 extending in the direction of the transfer line, on the upper surface, and a lower slide plate 12 coupled with the dovetail groove 10 in a freely movable manner and the lower die 8 is mounted on the upper surface of the slide plate 12 and coupled to it by means of a cotter pin 11.

The upper die holder 5 can move up and down with a reciprocating movement along the guide columns 3 when the crankshaft rotates, as the holder is supported and driven by an eccentric portion of the crankshaft. The holder is provided with a dovetail groove 13 extending in the direction of the transfer line, in its lower surface, and provided with an upper slide plate 15 engaging in a freely movable manner with the dovetail groove 13, and coupled to the upper die holder 5 by the cotter pin 14.

At the center of the upper slide plate 15, a through-hole 17 is bored with a peripheral groove 17*a*, and the upper die 9 installed. on the lower surface of the lower die support holder 18 is provided with a flange 18*a* that can engage with the peripheral groove 17*a* of the through-hole 17 and is inserted through the top of-the through-hole 17.

The crank shaft is connected to the output shaft (not illustrated) of a motor through a universal coupling and a speed reduction gear, and when the motor operates, the upper die holder 5 moves towards and away from the transfer line S, so that the upper die 9 mounted on the die holder 5 via the lower die support holder 18, also moves towards and away from the lower die 8.

When the material to be pressed 2 is pressed and formed in the direction of its thickness using the plate reduction press machine shown in FIGS. 1 and 2, the motor is operated and the crankshaft is rotated. Then, the material to be pressed 2 is inserted from the upstream A side of the transfer line, into the gap between the upper die 9 and the lower die 8. The material to be pressed 2 moves from the upstream A side of the transfer line along the transfer line S towards the downstream Side B of the transfer line, while the material is pressed and shaped in the direction of its thickness by the upper die 9 that moves towards and away from the transfer line S according to the movement of the eccentric portion of the crank shaft.

When the lower die 8 is to be replaced, the cotter pin 11 that locates the lower slide plate 12 in the lower die holder 4 is removed, the lower slide plate 12 is pulled out along the dovetail groove 10 of the lower die holder 4, the lower die 8 is moved out of the plate reduction press machine, the lower die 8 mounted on the lower die holder 4 is released from the lower die holder 4, and then the lower die 8 is lifted up by a hoist not illustrated and transferred to another predetermined site. Using the same hoist, a new lower die 8 is then lifted up, carried over the lower slide plate 12 and mounted there, and then the lower slide plate 12 is pushed into the center of the plate reduction press machine along the dovetail groove 10 of the lower die holder 4, and locked on the lower die holder 4 using the cotter pin 11.

When the upper die 9 is to be replaced, the cotter pin 14 that locates the upper slide plate 15 to the upper die holder 5 is removed, the upper slide plate 15 is pulled out along the dovetail groove 13 of the upper die holder 5, and is moved out of the plate reduction press machine, the upper die support holder 18 incorporated in the upper slide plate 15 is lifted up by a hoist not illustrated and taken to another predetermined site, and after the upper die 9 is removed from the die support holder 18, a new upper die 9 is mounted on the upper die support holder 18, and then the die support holder 18 is lifted up by the hoist and carried above the upper slide plate 15, and after the holder 18 is positioned in the through-hole 17 of the upper slide plate 15, the slide plate 15 is pushed in along the dovetail groove 13 of the upper die holder 5, into the center of the plate reduction press machine, and then locked in the upper die holder 5 by the cotter pin 14.

However, with the plate reduction press machine shown in FIGS. 1 and 2, the wear of the lower and upper dies 8, 9 is so severe that each die 8 or 9 must be replaced frequently. Consequently, unless the dies are often replaced, the specified capacity of the plate reduction press machine, even if it has a high efficiency, cannot be achieved, and this is a problem.

2. Conventionally, a rough rolling mill is used to roll a slab. The slab to be rolled may be as short as 5 m to 12 m, and a plurality of rough rolling mills are required to roll the slab or the slab must be rolled backwards and forwards in a reversing rolling system, to obtain the predetermined thickness of the slab. In addition, it is planned to use a reduction press machine of which an example is shown in FIG. 3. The example shows a case in which cranks and connecting rods are used; the cranks 104 are connected to the dies 102 installed above and below the slab 101, through connecting rods 103, and the dies 102 are moved up and down to press on the slab. The slab 101 is moved by pinch rolls 106 and the transfer table 107.

Recently, a continuous casting system has been introduced to produce a long slab, so it is necessary to move the slab continuously to a reduction press machine after it leaves the casting system. When a slab is rough rolled with a rough rolling mill, there is a minimum nip angle (about 17 ∞), and the permissible reduction Δ t per rolling operation is about 50 mm. Reversing rolling cannot be applied because the slab is continuous, therefore to achieve a predetermined thickness, it is necessary to provide a plurality of rough rolling mills in series, or if one rolling machine is used, the diameter of the working rolls must be made much greater. However, such a rough rolling mill with large diameter rolls is difficult to design and manufacture because of its high cost, and furthermore rolls with a large diameter must rotate at a low speed so that the rolls cannot be cooled easily, which results in a short life for the rolls. When a reduction press machine with cranks and connecting rods is used, the slab must be continuously moved even during pressing, so the slab is moved by pulling it with pinch rolls. As a result, there is a large load on the pinch rolls, which makes the size of the entire system large. Consequently, there are many problems with vibration and cost.

To solve these problems, the inventors of the present invention, invented and applied for a patent for the "Thickness reduction press machine" (unexamined Japanese patent application No.10-42328). This machine is shown in FIG. 4 and comprises dies 102 provided above and below the slab 101, a slider 108 provided for each die to give the die an up and down and backwards and forwards motion, and a drive system to drive these sliders. The aforementioned sliders are provided with a main unit 108*a* in which circular holes are bored with center lines at right angles to the direction of the slab, these circular holes with axes 109*a* engage with, cranks 109 (eccentric axes) with second axes 109*b* and a diameter less than the diameter of the holes, and the center lines of these axes are displaced from those of the holes. These cranks are rotated by the above-mentioned drive system.

With this configuration, when the cranks are rotated, the axes of the circular holes are cranked around the center line of the second set of axes, and this transmits an upwards and downwards and backwards and forwards movement to the main unit 108*a*. Thereby, the slider 108 can press the dies and give a forward movement to the dies during pressing, so that the slab 101 is pushed forwards (in the direction of drawing the slab) during pressing, so enabling a continuous pressing operation. In addition, according to this invention, the slab 101 is pressed by dies 102 from both above and below, so a large rolling reduction can be attained.

Although the aforementioned plate reduction press machine provides a large rolling reduction and can press a slab continuously, there is a proportionally severe wear on the upper and lower dies, possibly resulting in shorter intervals for replacing dies. As known in the prior art, there are die changing systems for reduction press machines, stentering machines, etc. However, even if any of the systems is adapted for use in a plate reduction press machine, there is the problem that excessive time and labor are spent in replacing dies.

3. Moreover, conventional reduction press machines such as slab presses that reduce the thickness of a slab, stentering presses that compress a slab laterally, or forging presses, incorporate dies that are constructed integrally.

When a high-temperature material, e.g. a slab, is compressed using a thickness reduction press, the temperatures of the dies are not distributed evenly in the direction of breadth (lateral direction of the slab), so the dies may often deform or crack. In addition, the sides of the center portion of the dies wear more than both ends. Therefore, when the center portion wears by a predetermined amount, the dies must be replaced even if both ends have not worn so much. When the size of the dies is large, integral dies cannot be manufactured easily, and they also become expensive.

SUMMARY OF THE INVENTION

1. The present invention has been accomplished in the above-mentioned circumstances, with the first object of providing a die changing apparatus for a plate reduction press machine, which can replace dies efficiently. The second object of the present invention is to offer an apparatus and method for changing dies so that the dies of a plate reduction press machine can be replaced easily in a short time.

To achieve the first object above, the die changing apparatus described in Claim 1 of the present invention is provided with an upper die support holder and a lower die support holder that are placed vertically on opposite sides of a transfer line, support holder guide rails provided on the upper die support holder and extending substantially horizontally in the lateral direction of the transfer line, an upper die that is provided with die rollers capable of rolling along the aforementioned guide rails and is mounted on the upper die support holder by means of the die rollers, a fixing device capable of fixing the upper die to the upper die support holder, a lower die mounted on the lower die support holder , a second fixing device capable of fixing the lower die to the lower die support holder, die fastening members for fastening the dies that are opposite each other on both sides of the upper and lower dies and are capable of being connected to both the upper and lower dies, and a die changing mechanism that can move one of the die fastening members substantially horizontally in the lateral direction of the transfer line.

In Claim 2 of the present invention, the die changing mechanism comprises a rack comprised of external guide rails that can be placed correctly opposite the support holder guide rails alongside the transfer line and allow the die rollers to roll and move thereon, a moving member comprised of moving-member rollers capable of rolling and moving on the external guide rails and is mounted on the rack by means of the moving-member rollers, an actuator capable of moving the moving-member in the lateral direction of the transfer line, and a connecting member that is fixed to the moving member and capable of being connected to one of the die fastening members.

The die changing apparatus specified in Claim 3 comprises, in addition to the components of the plate reduction press machine described in Claim 2, a plurality of the die changing mechanisms mounted on a turntable located alongside to the transfer line in such a manner that the external guide rails concerned with each die changing mechanism can be placed correctly opposite the support holder guide rails when the turntable rotates.

The die changing apparatus specified in Claim 4. of the present invention comprises, in addition to the components of the die changing apparatus specified in Claim 2, a plurality of die changing mechanisms which are mounted on a cart arranged alongside the transfer line that can be moved along the direction of the transfer line in such a manner that the external guide rail concerned with each die changing mechanism can be placed correctly opposite the support holder guide rails when the cart is moved.

The die changing apparatus specified in Claim 5 of the present invention comprises, in addition to the components of the die changing apparatus specified in Claim 1, a rack comprised of external guide rails that can be placed correctly opposite the support holder guide rails alongside the transfer line and allows the die rollers to roll and move thereon, a pulling rope one end of which can engage with one of the die fastening members on one side of the transfer line and the other end can engage with the other die fastening member on the other side of the transfer line, and a winch that pulls the pulling rope towards either end of the transfer line as selected.

The die changing apparatus specified in Claim 6 of the present invention comprises, in addition to the components of the die changing apparatus specified in Claim 5, two racks arranged on opposite sides of the transfer line in such a manner that the external guide rails of each rack can be placed correctly opposite the support holder guide rails.

In all of the die changing apparatuses specified in Claims 1 through 6 of the present invention, the upper die is fixed by means of the upper fixing device, on to the upper die support holder, and the lower die is fixed by the lower fixing device to the lower die support holder.

In addition, when the upper and lower fixing devices are released, the upper and lower dies that are connected together by means of the die fastening members and are supported on the support holder guide rails by the die rollers, are moved in a direction perpendicular to the transfer line using the die changing mechanism.

For the die changing apparatus described in Claim 2 of the present invention, the upper and lower dies are connected together by the die fastening members in the condition that the upper and lower fixing devices are released and the external guide rails are located correctly opposite the support holder guide rails, and then with the dies suspended from the support guide rails by the die rollers, a moving member is connected to one of the die fastening members, through a connecting member, and the moving member is moved by the actuator of the die changing mechanism along the external guide rails, in the direction lateral to the transfer line. In this way, the upper and lower dies connected together are moved from the support holder guide rails to the external guide rails, and vice versa.

For the die changing apparatus specified in Claim 3 of the present invention, the turntable is rotated to a location where the external guide rails of a predetermined die changing mechanism out of the plurality of die changing mechanisms are placed correctly opposite the support holder guide rails, the upper and lower dies to be replaced, whose upper and lower fixing devices are released, are connected together using the die fastening members, and after suspending the dies on the support holder guide rails by means of the dies rollers, a moving member is connected to a predetermined die fastening member by a connecting member, the moving member is moved along the external guide rails in the opposite direction to that of the transfer line, by means of the actuator of the die changing mechanism, thus the above-mentioned old upper and lower dies are moved from the support holder guide rails to the external guide rails of the predetermined die changing mechanism.

At the same time, new upper and lower dies connected integrally with the die fastening members are placed on the external guide rails of another die changing mechanism, and the moving member is connected to the aforementioned die fastening member via a connecting member.

After that, the turntable is rotated to the location where the external guide rails of the second die changing mechanism are opposite the support guide rails, the actuator of the second die changing mechanism is operated, and by moving the moving member towards the transfer line along the external guide rails, the new upper and lower dies are moved to the support holder guide rails, and after removing the die fastening member, the upper die is fixed by the upper fixing device, and the lower die is fixed by the lower fixing device.

For the die changing apparatus specified in Claim 4 of the present invention, the cart is moved to a location where the external guide rails of one of the die changing mechanisms are correctly opposite the support holder guide rails, and after suspending the old upper and lower dies to be replaced, whose upper and lower fixing devices have been released, and coupling the dies together by means of the die fastening members, the moving member is connected to one of the die fastening members via the connecting member, and by moving the aforementioned moving member in the opposite direction to that of the transfer line along the external guide rails by means of the actuator of the die changing mechanism, the above-mentioned old upper and lower dies are transferred from the support holder guide rails to the external guide rails of the die changing mechanism.

At the same time, new upper and lower dies connected together by the die fastening members are loaded on the external guide rails of another die changing mechanism, and the moving member is connected to the die fastening member by the connecting member.

After that, the cart is moved to a location where the external guide rails of the changing mechanism are correctly opposite the support holder guide rails, and by operating the actuator of the die changing mechanism and moving the moving member towards the transfer line along the external guide rails, the above-mentioned new upper and lower dies are moved to the support holder guide rails, and after removing the die fastening member, the upper and lower dies are fixed by means of the upper and lower fixing devices, respectively.

For the die changing apparatus described in Claim 5 of the present invention, the old upper and lower dies whose upper and lower fixing devices have been released, are coupled together using the die fastening members, and after suspending the dies on the support holder guide rails by means of the die rollers, one end of the pulling rope is attached to one of the die fastening members, and the other end is attached to the other die fastening member.

After the above, the winch of the die changing mechanism is operated so that the pulling rope is reeled in the direction that causes the die rollers to move towards the rack, thereby the aforementioned old upper and lower dies are transferred to the rack, the upper and lower dies are replaced with the new upper and lower dies, and the dies are suspended from the die rollers.

Then, the winch of the die changing mechanism is operated so that the pulling rope is reeled in the direction that causes the die rollers to move to the support guide rails, thus the above-mentioned new upper and lower dies are transferred to the support holder guide rails, and after removing the die fastening members, the upper and lower dies are fixed using the upper and lower fixing devices, respectively.

For the die changing apparatus specified in Claim 6 of the present invention, the old upper and lower dies to be replaced, whose upper and lower fixing devices have been released, are coupled together by means of the die fastening members, and after suspending the dies on the support holder guide rails by means of the die rollers, one end of the pulling rope is attached and fixed to one of the die fastening members, and the other end is attached and fixed to the other die fastening member.

At the same time, new upper and lower dies joined together with the die fastening members are placed on the external guide rails on the rack on one side.

Thereafter, the winch of the die changing mechanism is operated so that the pulling rope is reeled in the direction that causes the die rollers to move to the rack on the other side, thereby transferring the aforementioned old upper and lower dies to the rack on the other side.

Then, one end of the pulling rope disconnected from the die fastening members that connect the old upper and lower dies, is attached and fixed to one of the die fastening members that connect new upper and lower dies, and the other end of the rope is attached and fixed to the other die fastening member, and by operating the winch of the die changing mechanism so that the pulling rope is reeled in the direction that causes the die rollers of the new upper die to move to the support holder guide rails, thereby transferring the above-mentioned new upper and lower dies to the support holder guide rails, and after removing the die fastening members, the upper and lower dies are fixed by means of the upper and lower fixing tools, respectively.

To achieve the second object of the present invention according to Claim 7 of the invention, the die changing apparatus for a plate reduction press machine in which the upper and lower dies (102) are placed vertically above and below a slab (101) and are mounted on upper and lower sliders (108) movable in the direction of the thickness of the slab which push the dies towards the slab; the die changing apparatus comprises upper and lower die clamps (112) for fixing the individually detachable upper and lower dies, split rails (114) capable of ascending and descending, installed beneath the lower die holder and extending horizontally in a direction perpendicular to the press line, die changing rails (116) continuing from the aforementioned split rails and extending horizontally to the outside of the reduction press machine with support surfaces that are flush with the support, surfaces of the split rails in the raised position, a plurality of shift rails (118) having support surfaces flush with the support surfaces of the above-mentioned change rails, a sideways shift apparatus (120) for moving one of the aforementioned shift rails in the direction of the press line so that the shift rails are in a continuous line with the changing rails, and a die clamp moving apparatus (122) for moving the upper and lower die holders after the dies have been released from the die clamps from the raised split rails to the shift rails via the changing rails.

According to the die changing apparatus of Claim 9 of the present invention, the above-mentioned upper and lower die clamps (112) comprises a plurality of clamping cylinders **(112*a*) that push against the upstream and downstream ends of the die holders (110) in the press line, so as to fix the upper and lower dies, respectively, onto the loading surfaces of the upper and lower sliders (108)**.

The die clamp moving apparatus (122) described above can be composed also of a car, cylinder, etc. The shift rails (118) may also be arranged in two rows (new and old) or three rows or more.

Claim 10 of the present invention offers die changing methods for a plate reduction press machine using the above-mentioned die changing apparatuses; (A) a spacer (128) is placed between the upper and lower die holders (110), the clamping cylinders **(112*a*) are released, the die holders (110) are separated from the loading surfaces of the sliders (108) and removed from the die clamps, and at the same time, the upper die holder with its die is placed on the spacer resting on the lower die holder, (B) the split rails (114) are lifted, the aforementioned upper and lower die holders are positioned on the split rails, (C) the upper and lower die holders with the dies released from the die clamps are moved from the raised split rails to the shift rails via the changing rails, using the die clamp moving apparatus (122)**.

According to the methods of Claim 11 of the present invention, continuing from the previous paragraph, (D) a plurality of shift rails are moved simultaneously in the direction of the press line so that another pair of shift rails (118) is placed in a continuous line with the changing rails, using the sideways shift apparatus (120), (E) the upper and lower die holders with another set of dies located on another pair of shift rails, are moved onto the raised split rails via the changing rails, by means of the die clamp moving apparatus (122), the split rails (114) are lowered and the upper and lower die holders are separated from the split rails, (G) the clamping cylinders **(112*a*) are extended to push the upper and lower die holders (110) into close contact with the loading surfaces of the upper and lower sliders (108)**, and the spacer is removed.

According to the apparatus and method of the present invention as described above, upper and lower die holders with dies (new and old dies or dies with different dimensions or of different types) on a plurality of shift rails (118) can be exchanged easily, quickly and automatically using the sideways shift apparatus (120). In addition, old dies (worn or heat-cracked) can be replaced with new dies (unused dies or dies whose surfaces have been machined). Furthermore, different types of dies (with a thickness equal to the thickness of the bar at the output side, or with different shapes, angles, etc.) can be exchanged, hence the thickness of a bar at the output side can be changed, or different kinds of material can be pressed one after another. Moreover, two or more types of dies can be changed after pressing several slabs, and when the dies are not in use (placed outside the press machine), the dies can be cooled to extend the lives of the dies.

The apparatus according to Claim 8 of the present invention comprises change rails (124) extending horizontally outside the reduction press machine on the side opposite to the above-mentioned changing rails, and are. provided with supporting surfaces flush with the supporting surfaces of the changing rails, forming a continuous line with the split rails, and a die changing clamp moving apparatus (126) that moves the upper and lower die holders carrying other dies, which have been placed on the aforementioned changing rails, up to and over the raised split rails.

Using this apparatus according to the methods of Claim 12 of the present invention, it is preferred to move the upper and lower die holders carrying other dies, which have been placed on the changing rails, up to and over the raised split rails.

Using the apparatus and method of the present invention, as described above, the die changing clamp moving apparatus (126) can easily replace existing upper and lower die holders with another pair of upper and lower die holders carrying other dies, which have been placed on the changing rails, easily and quickly, so that changing dies can be a simplified, time-saving and automated process. Thus, changing the thickness of a bar by the use of a gap adjusting apparatus for the reduction press machine can be eliminated, different types of dies can be easily replaced and used, the life of dies can be prolonged by cooling them outside, and dies need not be cooled with water in the reduction press machine (or the water flow can be reduced). Therefore, the thickness of a slab can be made uniform at a high temperature.

2. In addition, the third object of the present invention is to provide press dies which are suitable for use with the aforementioned die changing apparatus and can make the distribution of temperatures on the slab uniform, in which it is possible to replace only the center portions of the dies because these portions wear sooner than the other portions, and which can be manufactured easily with a lower manufacturing cost.

With the aim of achieving the third object described above, Claim 13 of the present invention presents dies comprising an upper die and a lower die such that the material being pressed is positioned between the dies, with parallel surfaces and sloping surfaces on opposite sides of the material to be pressed, in which the press dies comprise a plurality of segments split in the lateral direction of the material being pressed.

When dies are comprised of segments divided in the lateral direction, the temperature distribution of each segment of the dies is made uniform, so that the occurrence of defects such as cracks and deformations is reduced drastically.

When a center portion of the dies wears, it is possible to replace only the central segments of the dies. Dies split into segments can be manufactured more easily than dies consisting of large blocks, so the cost is lower.

According to Claim 14 of the invention, the surface of one of the above-mentioned segments of the dies, in contact with the surface of an adjacent segment is set at an angle to the direction of movement of the material being pressed.

By setting the surface of a segment in contact with an adjacent segment, at an angle to the direction of movement of the material being pressed (longitudinal direction), stripes produced on the material being pressed by the split segments during drawing can be reduced in size.

Claim 15 of the invention provides a passage for cooling water, inside the aforementioned split segments of the dies.

The life of split segments of dies can be prolonged by cooling by means of cooling water passages, constructed inside the segments.

According to Claim 16 of the present invention, a plurality of grooves are formed in at least one of the parallel or sloping surfaces of the segments of the dies.

Slippage between the segments of the dies and the material being pressed can be reduced by means of grooves formed in either or both the parallel or sloping surfaces of the segments of the dies, in contact with the material being pressed. In addition, the flow of the material being pressed can be regulated better when the material is pressed and formed to change.

According to Claim 17 of the present invention, a plurality of raised parts are formed on at least one of the parallel or sloping surfaces of the above-mentioned segments of the dies.

Slippage between the segments of the dies and the material being pressed can be reduced, by forming raised parts on either or both the parallel or sloping surfaces of the segments of the dies, which are in contact with the material being pressed.

Other objects and advantages of the present invention will be clarified in the following paragraphs and by referring to the attached drawings.

DESCRIPTION OF PREFERRED EMBODIMENTS

Figure 1:
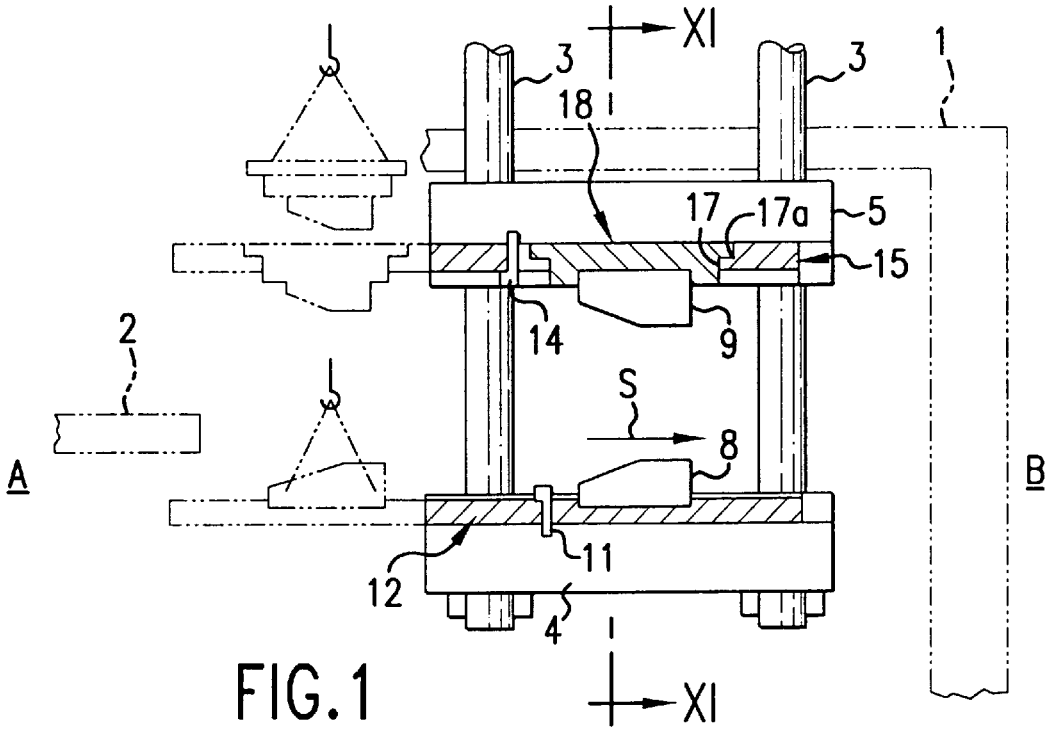
FIG. 1 is. a schematic view of an example of a conventional plate reduction press machine.
Figure 2:
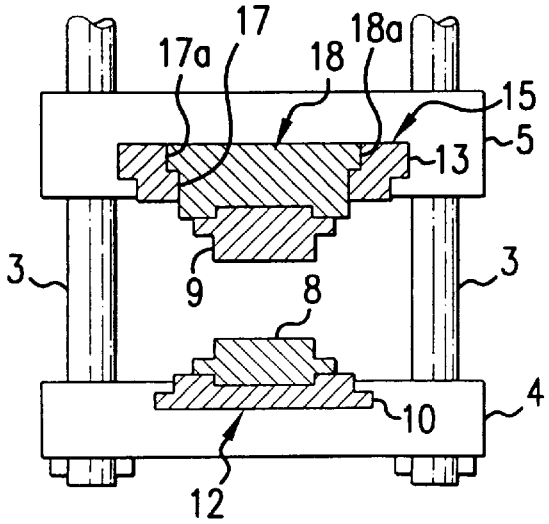
FIG. 2 is a section view of FIG. 1 along the line XI—XI.
Figure 3:
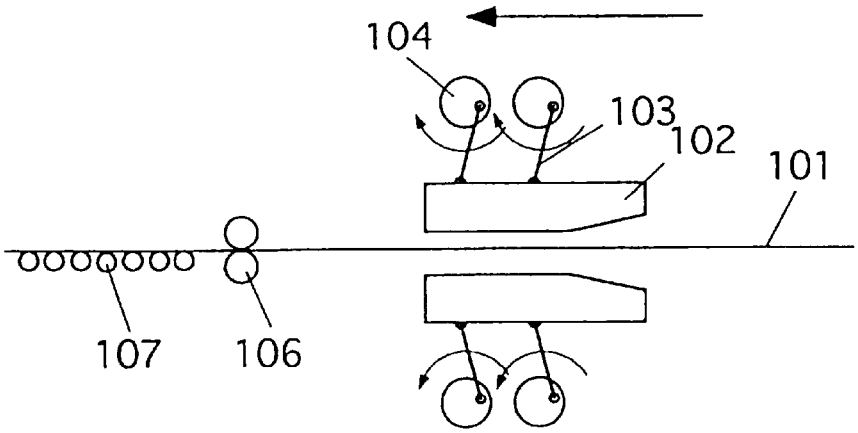
FIG. 3 shows a schematic arrangement of a conventional plate reduction press.
Figure 4:
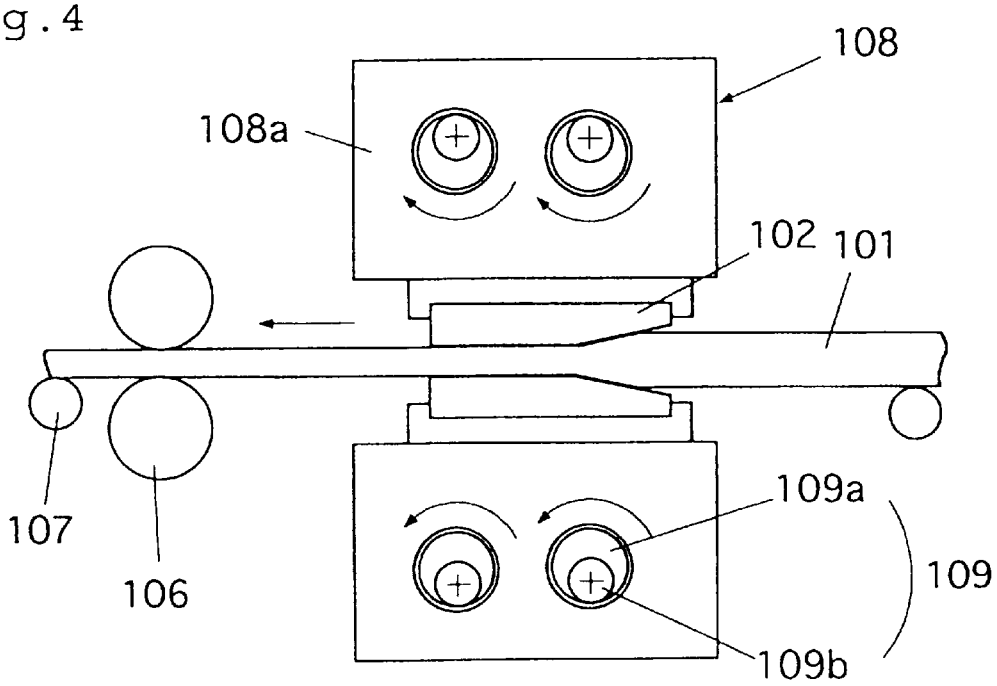
FIG. 4 is a schematic arrangement of a plate reduction press of an unexamined Japanese patent application.
Figure 5:
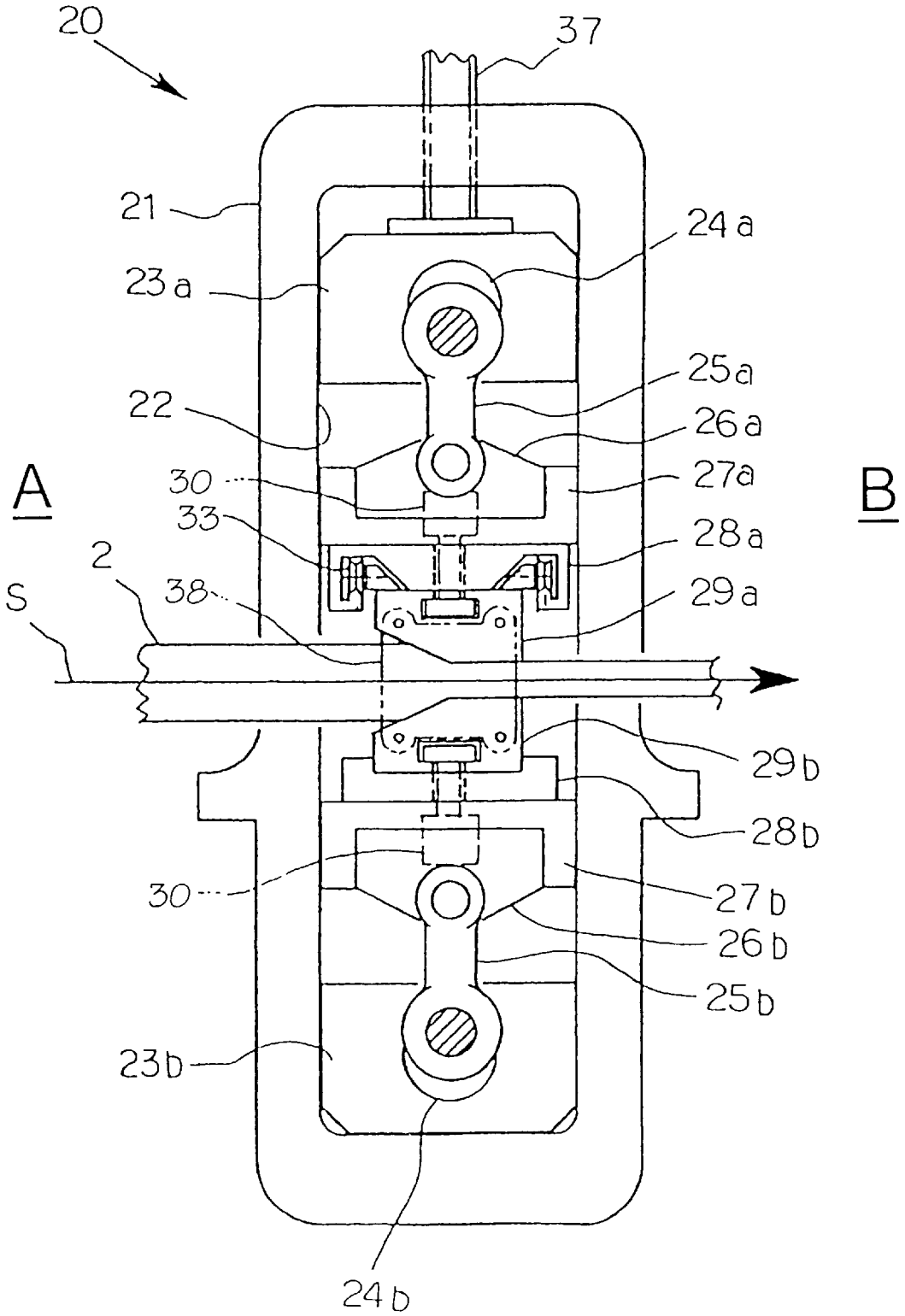
FIG. 5 is a schematic view showing the main reduction press machine provided with a die changing apparatus according to the present invention.
Figure 6:
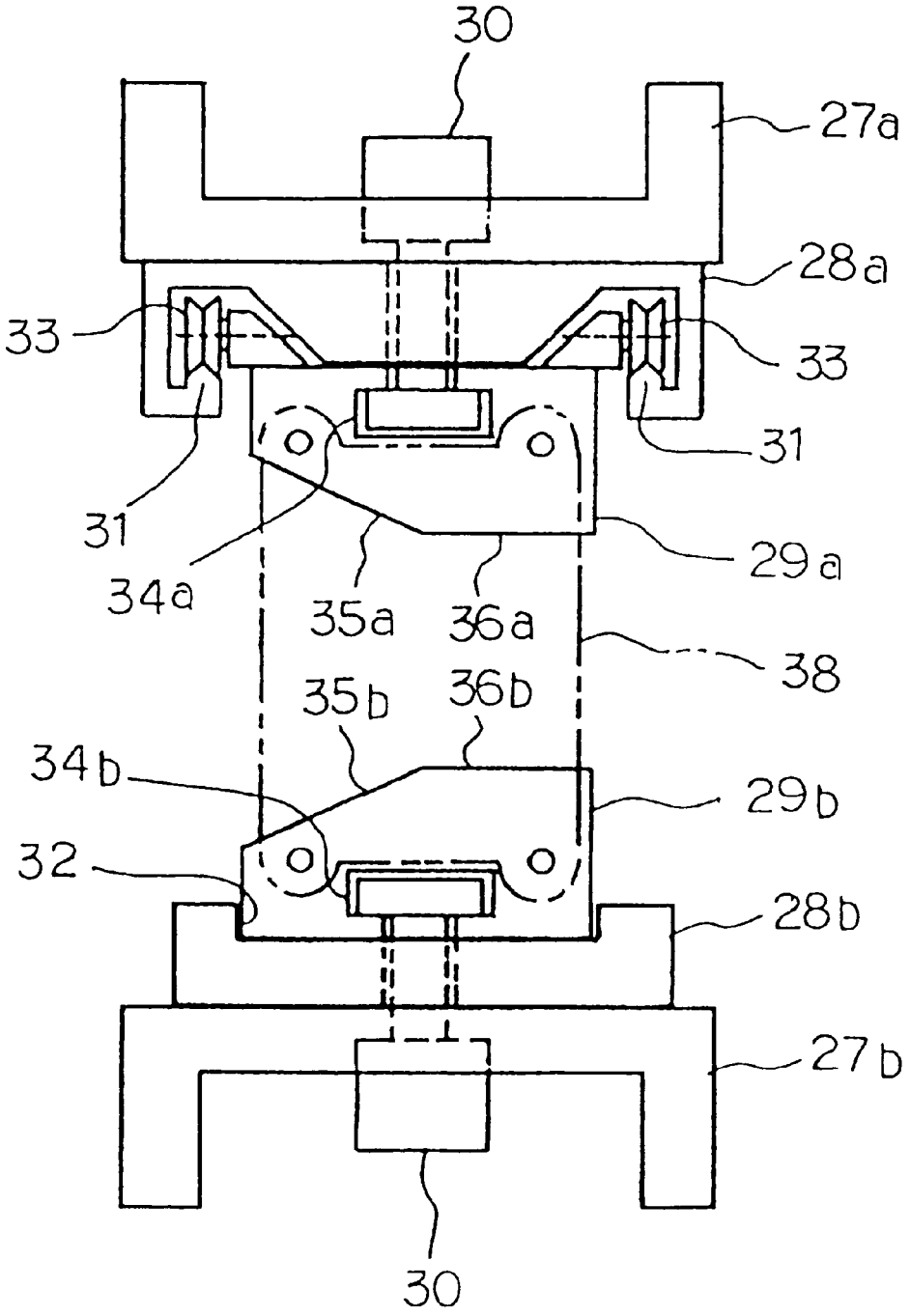
FIG. 6 is an enlarged view of parts of the dies related to FIG. 5.

The embodiments of the present invention are described in the following paragraphs, referring to the drawings.

(First embodiment)

FIGS. 5 through 9 show the first embodiment of the plate reduction press machine according to the present invention.

A plate reduction press machine 20 comprises a housing 21 erected at a predetermined location in a transfer line S for the purpose of pressing a material 2, an upper journal box 23*a* and a lower journal box 23*b* housed in window portions 22 of the housing 21, facing each other across the transfer line S, upper and lower crank shafts 24*a*, 24*b* extended substantially horizontally in the lateral direction of the transfer line S, whose non-eccentric portions are supported by bearings (not illustrated) in the upper journal box 23*a* and the lower journal box 23*b*, respectively, rods 25*a*, 25*b* supported by bearings on the eccentric portions of the aforementioned crank shafts 24*a*, 24*b* at the extreme ends thereof while being rotated, above and below the transfer line S, respectively, an upper die holder 27*a* and a lower die holder 27*b* connected to the ends of the rods 25*a*, 25*b* through brackets 26*a*, 26*b*, an upper die 29*a* mounted on the above-mentioned die holder 27*a* by an upper die support holder 28*a*, and a lower die 29*b* mounted on the lower die holder 27*b* by a lower die support holder 28*b*.

The crank shafts 24*a*, 24*b* are connected to the output shaft (not illustrated) of a motor, via a universal coupling and a speed reduction gear (not illustrated), and when the motor is operated, the upper and lower dies 29*a*, 29*b* move towards and away from each other in synchronism with the transfer line S.

The upper die holder 27*a* and the lower die holder 27*b* are housed so they are free to slide in the window portion 22 of the housing 21, and are provided with hydraulic cylinders 30 arranged to extend the tips of piston rods through the upper.and lower die support holders 28*a*, 28*b*.

The upper die support holder 28*a* is fixed on the lower surface of the upper die holder 27*a* and provided with support holder guide rails 31 that are fixed on the bottom surface of the upper die holder 27*a*, the rails face each other with a predetermined spacing in the direction of the transfer line, extend in the lateral direction of the transfer line S parallel to each other, and each is shaped to be convex at the top, on the lower surfaces.

The lower die support holder 28*b* is fixed on the upper surface of the lower die holder 27*b*, and is provided with a square groove 32 extending in the lateral direction of the transfer line S, as wide as appropriate for the length in the longitudinal direction of the transfer line of the lower die 29*b*, on the upper surface of the lower die holder.

The upper die 29*a* is provided with a plurality of die rollers 33 that are mounted on and protrude outwards from both ends of the upper surface in the direction of the transfer line, and arranged in rows to be capable of rolling along the aforementioned support holder guide rails, and a dovetail groove 34*a* in the center portion of the upper surface, penetrating in the direction lateral to the transfer line.

This dovetail groove 34*a* is shaped to allow the insertion of and engagement with the tip of the piston rod of the above-mentioned hydraulic cylinder 30 when the upper die 29*a* is mounted on the upper die support holder 28*a*, and when hydraulic pressure is applied to the hydraulic chamber at the rod end of the hydraulic cylinder 30, the top surface of the dovetail groove 34*a* is pressed into close contact with the upper die support holder 28*a* by the aforementioned tip of the piston rod so that the upper die 29*a* is fixed to the upper die support holder 28*a*.

The length of the lower die 29*b* in the longitudinal direction of the transfer line is such that the die can move along the dovetail groove 32 of the lower die support holder 28*b* described above, and the lower die is provided with a dovetail groove 34*b* in the center portion of the lower surface, penetrating in the lateral direction of the transfer line S.

This dovetail groove 34*b* receives and engages with the tip of the piston rod of the above-mentioned hydraulic cylinder 30 when the lower die 39*b* is mounted on the lower die support holder 38*b*, and the tip of the piston rod presses the bottom surface of the groove 34*b* into close contact with the lower die support holder 28*b* when hydraulic pressure is applied to the fluid chamber at the rod end of the hydraulic cylinder 30, and the lower die 29*b* is fixed on the lower die support holder 28*b*.

The upper die 29*a* and the lower die 29*b* are provided with flat forming surfaces 35*a*, 35*b* gradually tapering towards the transfer line S from the upstream A side of the transfer line to the downstream Side B of the line, and flat forming surfaces 36*a*, 36*b* continuing from these forming surfaces 35*a*, 35*b*, parallel to each other on opposite sides of the transfer line S.

The width of each die 29*a* or 29*b* is determined by the plate width (about 2,000 mm or more) of the material being pressed.

A position adjusting screw 37 is provided at the top of the housing 21, which drives the upper journal box 23*a* towards and away from the transfer line S, and by rotating this position adjusting screw 37, the upper die 29*a* is raised and lowered via the crank shaft 24*a*, the rods 25*a*, the upper die support holder 27*a*, etc., thereby the space between the upper die 29*a* and the lower die 29*b*, that is, the reduction caused by pressing the material being pressed, is adjusted.

The die fastening member 38 is provided to fasten the upper die 29*a* and the lower die 29*b* to form a single unit when replacing the upper and lower dies 29*a*, 29*b*.

The die fastening member 38 comprises a pair of left and right members with raised parts 38*a* that can contact both sides of each of the upper and lower dies 29*a*, 29*b* in the lateral direction of the transfer line and can be sandwiched between the contacting surfaces of the upper and lower dies 29*a*, 29*b*, and shaped so that each of the left and right members can be bolted to the upper die 29*a* and the lower die 29*b*. The bracket 39 shown in FIG. 7 is provided on the surface of each die fastening member 38, to which a connecting member 46 to be detailed later can be bolted.

Figure 7:
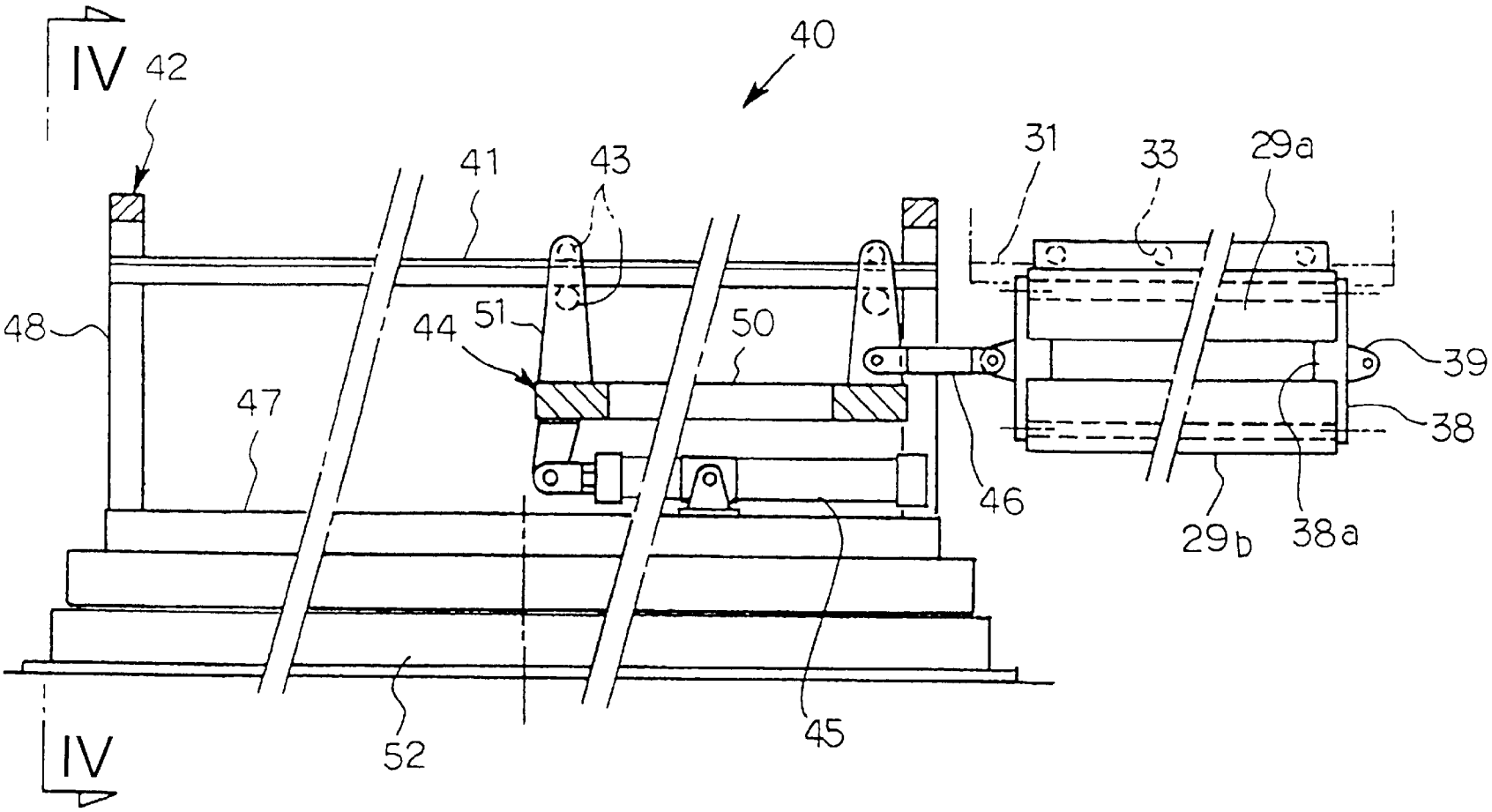
FIG. 7 is a schematic view showing the die changing mechanism of the first embodiment of the die changing apparatus according to the present invention.
Figure 8:
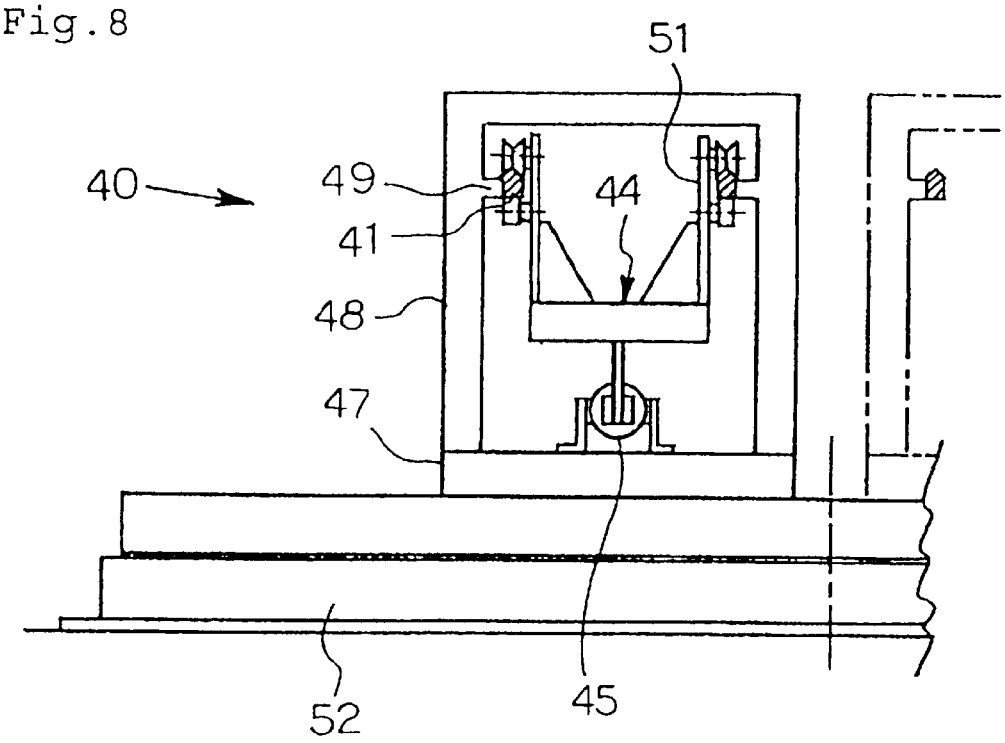
FIG. 8 is a section view of FIG. 7 along the line IV—IV.
Figure 9:
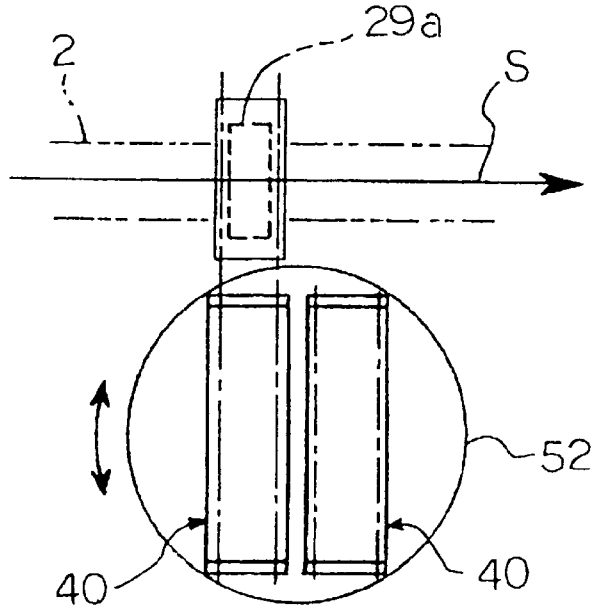
FIG. 9 is a plan layout view of the die changing mechanism shown in FIG. 7.

The die changing mechanism 40 comprises a rack 42 alongside the transfer line S as shown in FIGS. 7 and 8 that can be correctly aligned with the aforementioned support holder guide rails 31, and has external guide rails 41 on which the die rollers 33 roll and travel, a moving member 44 that is provided with rollers 43 for the moving member which can roll and travel along the above-mentioned external guide rails 41 and the moving member is mounted on the rack 42 by means of the aforementioned rollers 43, a hydraulic cylinder 45 which can drive the above moving member 44 in the lateral direction of the transfer line S, and connecting member 46 that is installed on the moving member 44 and can be connected to the bracket 39 of one of the die fastening members.

The rack 42 comprises a base 47, and gate columns 48 erected with a predetermined spacing between each other in the lateral direction of the transfer line on this base 47. The external guide rails 41 are supported by brackets 49 provided at a predetermined height inside the columns 48 and protruding inwards, and which have a pentagonal section with a peak at the top.

The moving member 44 comprises a main member 50 and legs 51 constructed at the 4 corners of the main member 50 of the moving member and extending upwards. When the external guide rails 41 are correctly opposite the support holder guide rails 31, one end of the connecting member 46 is bolted to the side of the two legs 51 installed on the transfer line side.

The moving member is equipped with rollers 43 which sandwich the external guide rails 41 from above and below, by using 2 rollers at the top of each leg 51.

Regarding the hydraulic cylinder 45, the cylinder unit is supported by bearings at the center of the top surface of the base 47 of the rack 42, near the transfer line in a horizontal position such that the cylinder can reciprocate in a direction parallel to the external guide rails 41, and the tip of the piston rod is connected through bearings to the bottom surface of the moving member 50. When hydraulic pressure is applied to the fluid chamber at the rod end of the above-mentioned hydraulic cylinder 45, the moving member 44 travels towards the transfer line. When hydraulic pressure is applied to the fluid chamber at the head end, the moving member 44 is driven in the reverse direction away from the transfer line.

With the plate reduction press machine shown in FIGS. 5 through 9, a turntable 52 is provided near the press 20 alongside the transfer line S, and two die changing mechanisms 40 are arranged with a predetermined spacing on the top of the turntable 52, and-by rotating the turntable 52, the external guide rails 41 of each rack 42 can be correctly aligned with the support holder guide rails 31 of the press 20.

When a material 2 to be pressed is pressed in the direction that reduces its thickness using the plate reduction press machine shown in FIGS. 5 to 9, the position adjusting screw 37 is rotated appropriately, and the spacing between the upper die 29*a* and the lower die 29 is determined according to the thickness of the material 2 to be reduced and shaped in the direction of the plate thickness.

Next, the motor is operated to rotate the upper and lower crank shafts 24*a*, 24*b*, and simultaneously, the material 2 to be pressed is inserted between the upper and lower dies 29*a*, 29*b* from the upstream side A of the transfer line. Then, the material 2 to be pressed is pressed, reduced and formed in the direction of plate thickness by the upper and lower dies 29*a*, 29*b* when the dies move towards and away from each other and relative to the transfer line S according to the displacement of the eccentric portions of the crank shafts 24*a*, 24*b* while traveling from the upstream side A to the downstream side B of the transfer line, along the transfer line S.

When the upper and lower dies 29*a*, 29*b* are to be replaced, the die fastening members 38 are placed in contact with both sides of the upper and lower dies 29*a*, 29*b*, the raised parts 38*a* are sandwiched between the upper and lower dies 29*a*, 29*b*, and then bolts are tightened to connect the upper and lower dies 29*a*, 29*b* into one unit, and after that, hydraulic pressure is applied to the fluid chamber at the head end of the hydraulic cylinders 30 that hold the upper dies 29*a*, 29*b*, thereby releasing the dies 29*a*, 29*b* that were fixed to the die support holders 28*a*, 28*b*, and the motor of the press 20 is operated slightly to separate the upper die support holder 28*a* from the lower die support holder 28*b*.

Then, the turntable 52 is rotated, and is stopped when the external guide rails 41 of the rack 42 of one of the two die changing mechanisms 40 installed on the turntable are correctly aligned with the support holder guide rails 31 of the press 20.

Hydraulic pressure is applied to the fluid chamber at the rod end of the hydraulic cylinder 45 of the die changing mechanism 40, thereby driving the moving member 44 to the press machine side, and after connecting the moving member 44 to the bracket 39 of the die fastening member 38 via the connecting member 46, the moving member 44 is moved to the side away from the press machine by applying hydraulic pressure to the fluid chamber at the head end of the hydraulic cylinder 45. Then, the upper and lower dies 29*a*, 29*b* connected together by the die fastening members 38 are guided by the support holder guide rails 31 and travel on to the external guide rails 41, using the die rollers provided on the upper die 29*a*, and as a result, the upper and lower dies 29*a*, 29*b* are removed simultaneously from the press machine 20 and transferred to the rack 42 of the die changing mechanism 40.

In the meantime, new upper and lower dies 29*a*, 29*b* connected together by another pair of die fastening members 38 are mounted on the external guide rails 41 of the rack 42 of another die changing mechanism 40 installed on the turntable 52, and the bracket 39 of the die fastening members 38 is connected to the moving member 44 of the die changing mechanism 40 through the connecting member 46.

The turntable 52 is rotated again, and is stopped when the external guide rails 41 of the rack 42 of the other die changing mechanism 40 of the two die changing mechanisms 40 provided on the turntable 52 are correctly aligned with the support guide rails 31 of the press machine.

Here, hydraulic pressure is applied to the fluid chamber at the rod end of the hydraulic cylinder 45 of the die changing mechanism 40 to move the moving member 44 towards the press machine, then the upper and lower dies 29*a*, 29*b* vertically coupled by the die fastening members 38 connected to the moving member 44 through the connecting member 46, are guided along the external guide rails 41 by the die rollers 33 provided on the upper die 29*a*, and as a result both upper and lower dies 29*a*, 29*b* are transferred simultaneously from the rack 42 of the die changing mechanism 40 to the press machine 20.

At this time, the ends of the piston rods of the hydraulic cylinders 30 that fix the upper and lower dies 29*a*, 29*b* engage automatically with each of the dovetail grooves 34 provided in the upper and lower dies 29*a*, 29*b*.

After the upper and lower dies 29*a*, 29*b* are transferred to the press machine 20, the connecting member 46 is disconnected from the die fastening members, the motor of the press machine 20 is operated to make the upper die support holder 28*a* move slightly towards the lower die support holder 28*b*, and after removing the die fastening members 38 bolted to both sides of the upper and lower dies 29*a*, 29*b*, hydraulic pressure is applied to the fluid chambers at the rod ends of the hydraulic cylinders 30 that fix the upper and lower dies 29*a*, 29*b*, thereby the dies 29*a*, 29*b* are fixed to the die support holders 28*a*, 28*b*, respectively.

Thus, replacing the dies 29*a*, 29*b* is finished.

As described above, with the plate reduction press machine shown in FIGS. 5 through 9, die fastening members 38 are provided that can connect the upper and lower dies 29*a*, 29*b* vertically to form one unit, and the die changing mechanism 40 is also provided that can mount the freely detachable upper and lower dies 29*a*, 29*b* on to the press machine 20, so the upper and lower dies 29*a*, 29*b* can be quickly replaced, and the plate reduction efficiency of the plate reduction press machine can be maintained at a high level.

(Second embodiment)

Figure 10:
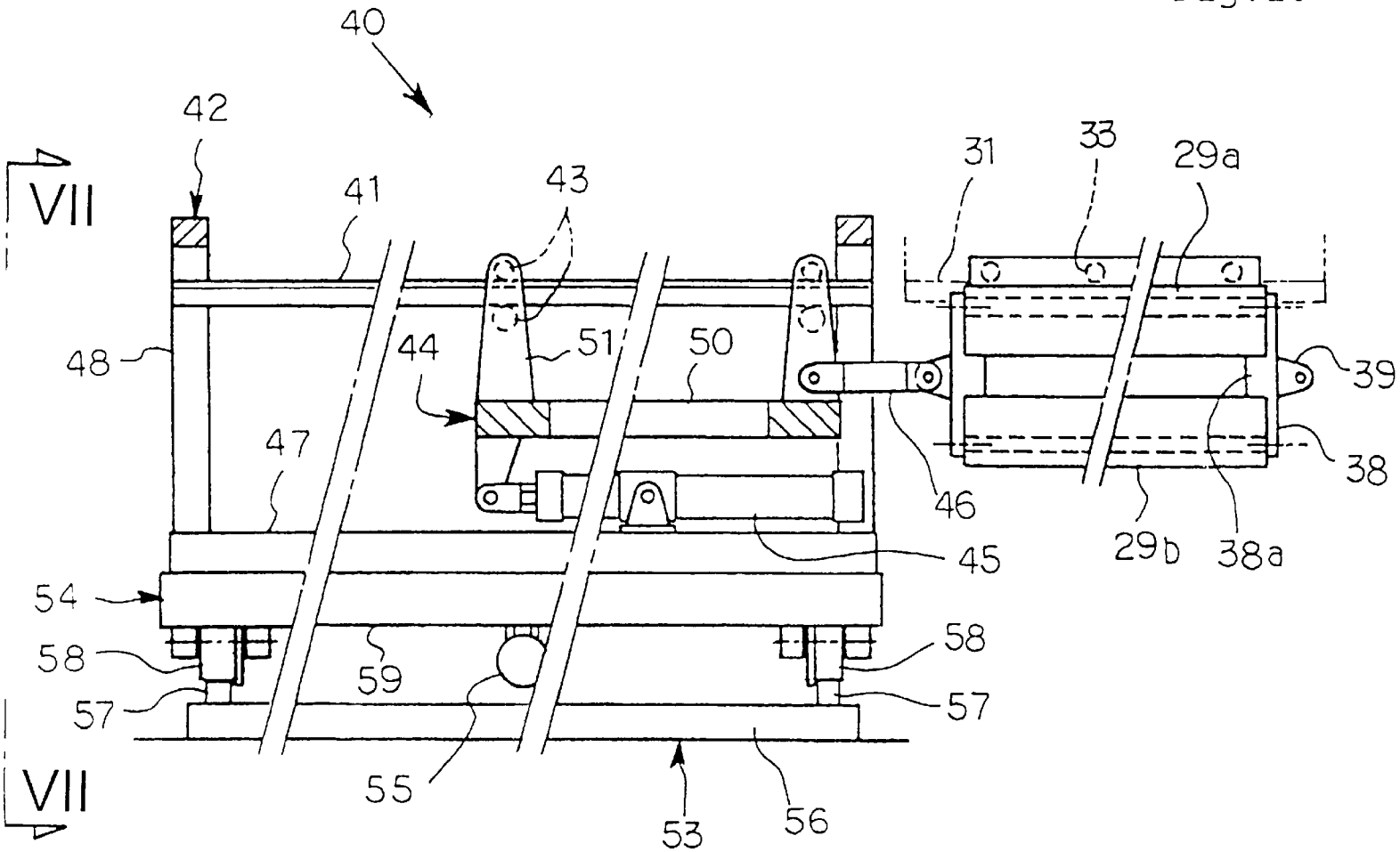
FIG. 10 is a schematic view showing the die changing mechanism of the second embodiment of the die changing apparatus according to the present invention.
Figure 11:
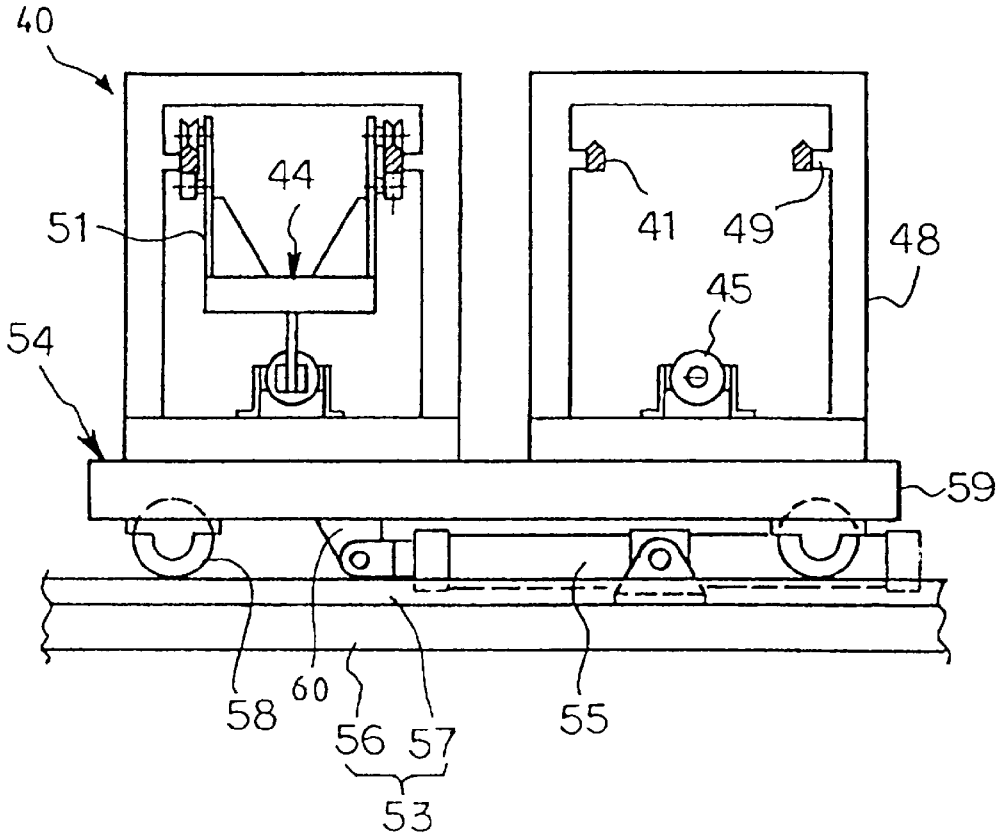
FIG. 11 is a section view of FIG. 10 along the line VII—VII.
Figure 12:
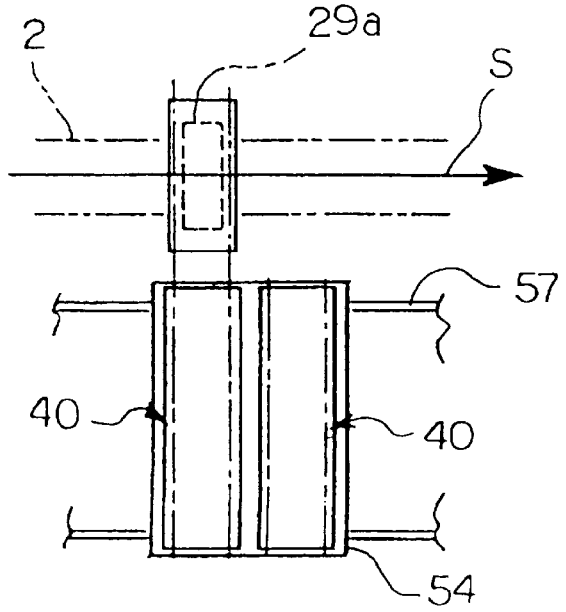
FIG. 12 is a plan layout view of the die changing mechanism shown in FIG. 10.

FIGS. 10 through 12 show the second embodiment of the plate reduction press machine according to the present invention, and the numerals used in FIGS. 10 to 12 refer to the same objects as those in FIGS. 5 to 9.

This press machine comprises tracks 53 installed on one side of the transfer line S and extending in a direction parallel to the line S for transporting a cart 54 that can travel along the tracks 53, a hydraulic cylinder 55 that can move the cart 54, and two die changing mechanisms 40 installed on the cart 54.

The tracks 53 consist of a foundation frame 56 installed near the press machine 20 on one side of the transfer line S, and a pair of rails 57 installed substantially horizontally parallel to each other with a predetermined spacing in the lateral direction of the transfer line S on the upper surface of the foundation frame 56, also along the transfer line S.

The cart 54 is provided with a plurality of wheels 58 that can roll and move along the rails 57, and a cart body 59 formed to be capable of carrying the die changing mechanisms 40; the external guide rails 41 of each rack 42 of the two die changing mechanisms 40 installed on the cart body 59 can be correctly aligned with the support holder guide rails 31 of the press machine 20 when the cart 54 is moved.

The hydraulic cylinder 55 is arranged substantially horizontally inside the foundation frame 56 of the tracks 53; a cylinder unit is supported by bearings from the foundation frame 56 of the tracks 53, and the tip of the piston rod is connected through bearings to the bracket 60 provided on the lower surface of the cart body 59 of the cart 54, and the cart 54 can be moved by applying hydraulic pressure to the fluid chamber at the head end or to the fluid chamber at the rod end.

When the upper and lower dies 29*a*, 29*b* are to be replaced, the dies 29*a*, 29*b* are connected together in the same manner as for the plate reduction press machine shown in FIGS. 5 through 9, the dies 29*a*, 29*b* fixed on the die support holder 28*a*, 28*b* are released, and the upper die support holder 28*a* is separated slightly from the lower die support holder 28*b*.

Next, hydraulic pressure is applied to the fluid chamber at the head end or rod end of the hydraulic cylinder 55, and the cart 54 is moved and stopped at a location where the external guide rails 41 of the rack 42 of one of the two die changing mechanisms 40 installed on the cart 54 is placed correctly opposite the support holder guide rails 31 of the press machine 20.

After that, the upper and lower dies 29*a*, 29*b* are removed simultaneously from the press machine 20 using the same operations as those of the press machine shown in FIGS. 5 through 9, and the dies are transferred to the rack 42 of the die changing mechanism 40.

Meanwhile, new upper and lower dies 29*a*, 29*b* connected together using another pair of die fastening members 38 are mounted on the external guide rails 41 of the rack 42 of the other die changing mechanism 40 installed on the cart 54, and the bracket 39 of a die fastening member 38 is connected to the moving member 44 of the die changing mechanism 40, by the connecting member 46.

The cart 54 is moved again and stopped at a location where the external guide rails 41 of the rack 42 of the other one of the two die changing mechanisms 40 provided on the cart 54, are aligned correctly in front of the support holder guide rails 31 of the press machine 20.

Here, new upper and lower dies 29*a*, 29*b* are transferred simultaneously from the rack 42 of the die changing mechanism 40 to the press machine 20 using the same operations as those of the plate reduction press machine shown in FIGS. 5 to 9, and the holders 29*a*, 29*b* are fixed onto the die support holders 28*a*, 29*b*, respectively.

The aforementioned operations finish the replacement of the dies 29*a*, 29*b*.

As described above, the upper and lower dies 29*a*, 29*b* can also be replaced quickly with the plate reduction press machine shown in FIGS. 10 to 11, in the same way as with the first embodiment of the present invention shown in FIGS. 5 to 9, so the plate reduction efficiency of the press machine can be maintained at a high level.

(Third embodiment)

Figure 13:
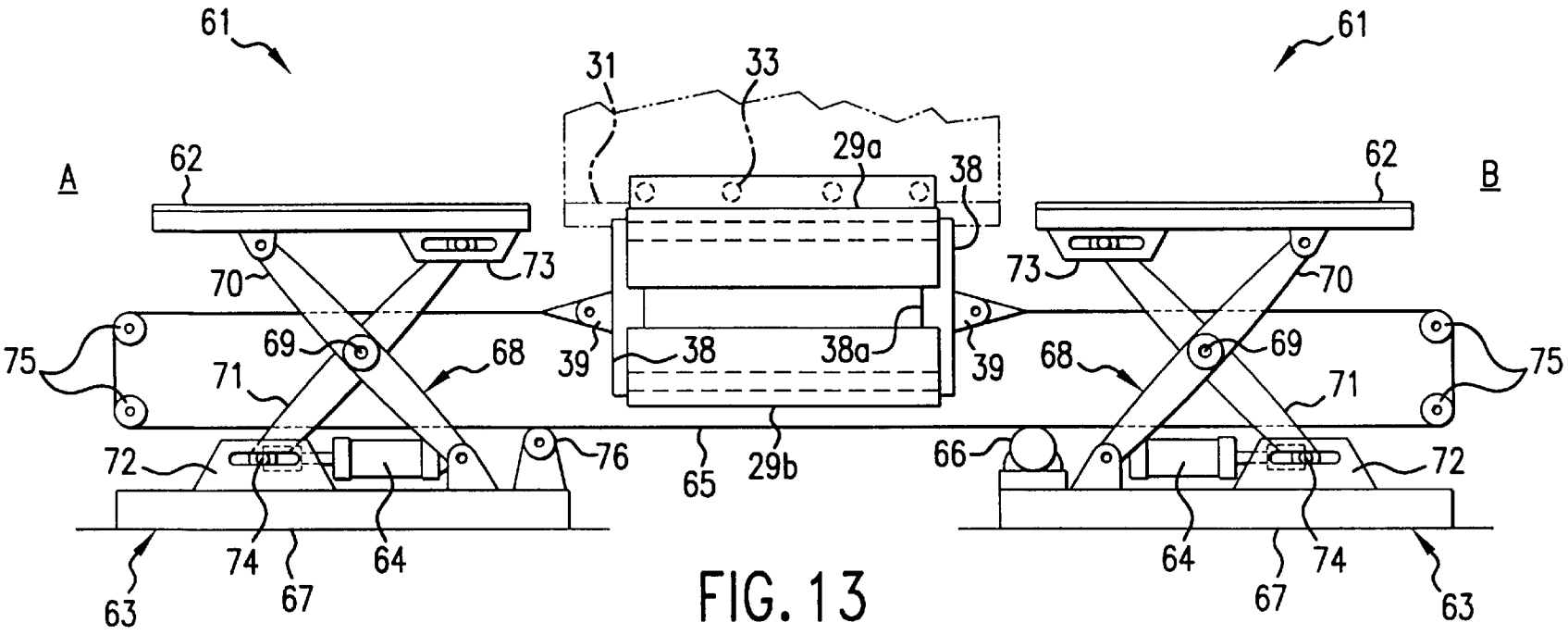
FIG. 13 is a schematic view showing the die changing mechanism of the third embodiment of the die changing apparatus according to the present invention.

FIG. 13 shows the third embodiment of the plate reduction press machine according to the present invention, and the numerals used in the drawing refer to the same objects as those in FIGS. 5 to 9.

Die changing mechanisms 61 are arranged on both sides of the transfer line S, and each mechanism comprises a rack 63 provided with external guide rails 62 that can be correctly aligned with the support holder guide rails 31 of the press machine 20 and which allow the die rollers 33 to roll and move thereupon, a hydraulic cylinder 64 that can raise and lower the external guide rails 62 relative to the rack 63, a wire rope 65 of which one end is connected and fixed to one of the die fastening members 38 on one side of the transfer line S and the other end is connected and fixed to the other die fastening member 38 on the other side of the transfer line S, and a winch 66 that pulls the wire rope 65 towards one or, the other side of the transfer line S as selected.

The rack 63 comprises a base 67 and a pair of diagonal cross arms 68 arranged at a predetermined spacing on the upper surface of the base 67 in the direction parallel to the transfer line S.

The diagonal cross arms 68 comprise two links 70, 71 joined with a pin 69 at an intermediate position in the longitudinal direction of the links where they cross each other; one of the links 70 is connected through bearings to a base at the end of the base 67 nearest the press machine 20, and the tip is provided with a bearing that supports one end of the external guide rails 62 on the opposite side to the press machine; the other link 71 comprises a base that is provided on the side opposite to the press machine on the base 67 and is supported in a movable manner by a guide member 72 extending in the lateral direction of the transfer line and a tip that engages with a guide member 73 provided at the end of the external guide rails 62, in a freely movable manner.

The hydraulic cylinder 64 comprises a cylinder supported from the center part of the base 67 by bearings, close to the press machine 20, and a piston rod whose tip is connected to the center of the axle 74 that connects the movable base of the other link 71 of the diagonal cross arms 68, in the direction parallel to the transfer line S; when hydraulic pressure is applied to the fluid chamber at the rod end, the piston rod is retracted and the diagonal cross arms 68 are raised, thereby raising the external guide rails 62; and when hydraulic pressure is applied to the fluid chamber at the head end, the piston rod is pushed out and the diagonal cross arm 68 are lifted, so that the external guide rails 62 are lowered.

Rope pulleys 75 are arranged on the center line of the press machine, at the far end of the base 67 on each of the racks 63, 63, and rope guide rollers 76 are provided close to the press machine 20 on opposite side of the transfer line S (Side A shown in FIG. 13).

A winch 66 is installed near the press machine 20 on the center line of the base of the rack 63 on one side (B side shown in FIG. 13) of the transfer line S.

When a wire rope 65 is rewound from the winch 66 on one side (B side in FIG. 13) of the transfer line S, one end thereof passes over the rope pulleys 75, 75 on one side of the transfer line S, and is attached to the bracket 39 of one of the die fastening members 38; and the other end of the wire rope 65, rewound on the other side (Side A in FIG. 13) of the transfer line S, passes over rope guide rollers 76, and rope pulleys 75, 75 at the other end of the transfer line S, and is attached to the bracket 39 of the other die fastening member 38.

When the winch 66 is operated in such a direction that the wire rope 65 located on one side (B side in FIG. 13) of the transfer line S is wound in and the wire rope 65 located on the other side (Side A in FIG. 13) is rewound, the upper and lower dies 29*a*, 29*b* can be pulled out by one of the die fastening members 38 to one side (B side in FIG. 13) of the transfer line S; when the winch 66 is operated in the opposite direction such that the wire rope 65 located on the one side (B side in FIG. 13) of the transfer line S is rewound and the wire rope 65 located on the other side (Side A in FIG. 13) is wound in, the upper and lower dies 29*a*, 29*b* can be pulled out to the other side (Side A in FIG. 13) of the transfer line S.

When the upper and lower dies 29*a*, 29*b* must be replaced, the dies 29*a*, 29*b* are connected together into one unit by the same operations as for the plate reduction press machine shown in FIGS. 5 through 9, the dies 29*a*, 29*b* fixed to the die support holders 28*a*, 28*b* are released, and the upper die support holder 28*a* is separated slightly from the lower die support holder 28*b*.

Next, hydraulic pressure is applied to the fluid chamber at either the rod or head end of the hydraulic cylinder 64, thereby the external guide rails 62 are raised or lowered, so that the top of the external guide rails 62 is made flush with the top of the support holder guide rails 31 of the press machine.

In addition, one end of the wire rope 65 rewound of the winch 65 on one side (B side in FIG. 13) of the transfer line S is attached and fixed to the bracket 39 of one of the die fastening members 38, and the other end of the wire rope 65, rewound to the other side (Side A in FIG. 13) of the transfer line S is fixed to the bracket 39 of the other die fastening member 38.

After the above, the winch 65 is operated in such a direction that the wire rope 65 extending on one side (B side in FIG. 13) of the transfer line S is wound in and the wire rope 65 extending on the other side (Side A in FIG. 13) is rewound, the upper and lower dies 29*a*, 29*b* are pulled out of the press machine 20 together, and transferred to the rack 63 of the die changing mechanism 61 on the B side in FIG. 13.

At that time, new upper and lower dies 29*a*, 29*b* connected together vertically by another pair of die fastening members 38 are mounted on the external guide rails 62 of the rack 63 on the die changing mechanism 61 on the other side (Side A in FIG. 13) of the transfer line, the bracket 39 of the die fastening members 38 on the transfer line side of the dies 29*a*, 29*b* is connected to the bracket 39 of the die fastening members 38 on the other side of the transfer line of the old dies 29*a*, 29*b*, and the other end of the wire rope 65 is attached and fixed to the bracket 39 of the die fastening members 38 on the side opposite to the transfer line, of the new dies 29*a*, 29*b*, thereby the new dies 29*a*, 29*b* can be installed in the press machine 20 at the same time that the old dies 29*a*, 29*b* are pulled out of the press machine 20.

After that, each of the dies 29*a*, 29*b* is solidly coupled to each of the die support holders 28*a*, 28*b* by the same operations as those of the first embodiment of the present invention shown in FIGS. 5 to 9, after disconnecting the die fastening members 38 of the new and old dies 29*a*, 29*b* an d each end of the wire rope 65.

Thus replacing the dies 29*a*, 29*b* is completed.

Hence, the upper and lower dies 29*a*, 29*b* can be replaced as quickly as with the first embodiment of the present invention shown in FIGS. 5 through 9, therefore the plate reduction efficiency of the plate reduction press machine can be maintained at a high level.

However, the plate reduction press machine according to the present invention is not limited only to the embodiments described above, but various modifications, for example, a single die changing mechanism can also be provided beside the press machine, are also included in the scope of the invention, as a matter of course.

As described above, the plate reduction press machine according to the present invention can offer the following miscellaneous excellent advantages.

(1) Any of the die changing apparatuses for a plate reduction press machine, specified in Claims 1 through 6 of the present invention, comprises die fastening members that can clamp the upper and lower dies vertically together to form a single unit, and die exchanging mechanisms that can move the die fastening members in the direction lateral to the transfer line, therefore the operation of replacing upper and lower dies can be carried out quickly, and the plate thickness reduction efficiency of the press machine can be maintained at a high level.

(2) With the die changing apparatus for a plate reduction press machine, specified in Claim 2 of the present invention, the actuator of the die changing mechanism is operated to quickly transfer the upper and lower dies connected together into a single unit by the die fastening members using the moving member equipped with rollers, from the upper and lower die support holders to the external guide rails on the rack.

(3) In any of the die changing apparatuses for a plate reduction press machine described in Claims 3, 4 and 6 of the present invention, two or more die changing mechanisms are provided, with which old dies can be removed by one die changing mechanism and new dies can be mounted by another die changing mechanism, so that dies can be replaced more quickly.

(4) With the die changing apparatus s for a plate reduction press machine, specified in Claim 5 of the present invention, the winch of the die changing mechanism is operated to quickly move the upper and lower dies connected together by the die fastening members, using the pulling rope, from the upper and lower die support holders to the external guide rails of the rack.

(Fourth embodiment)

Figure 14:
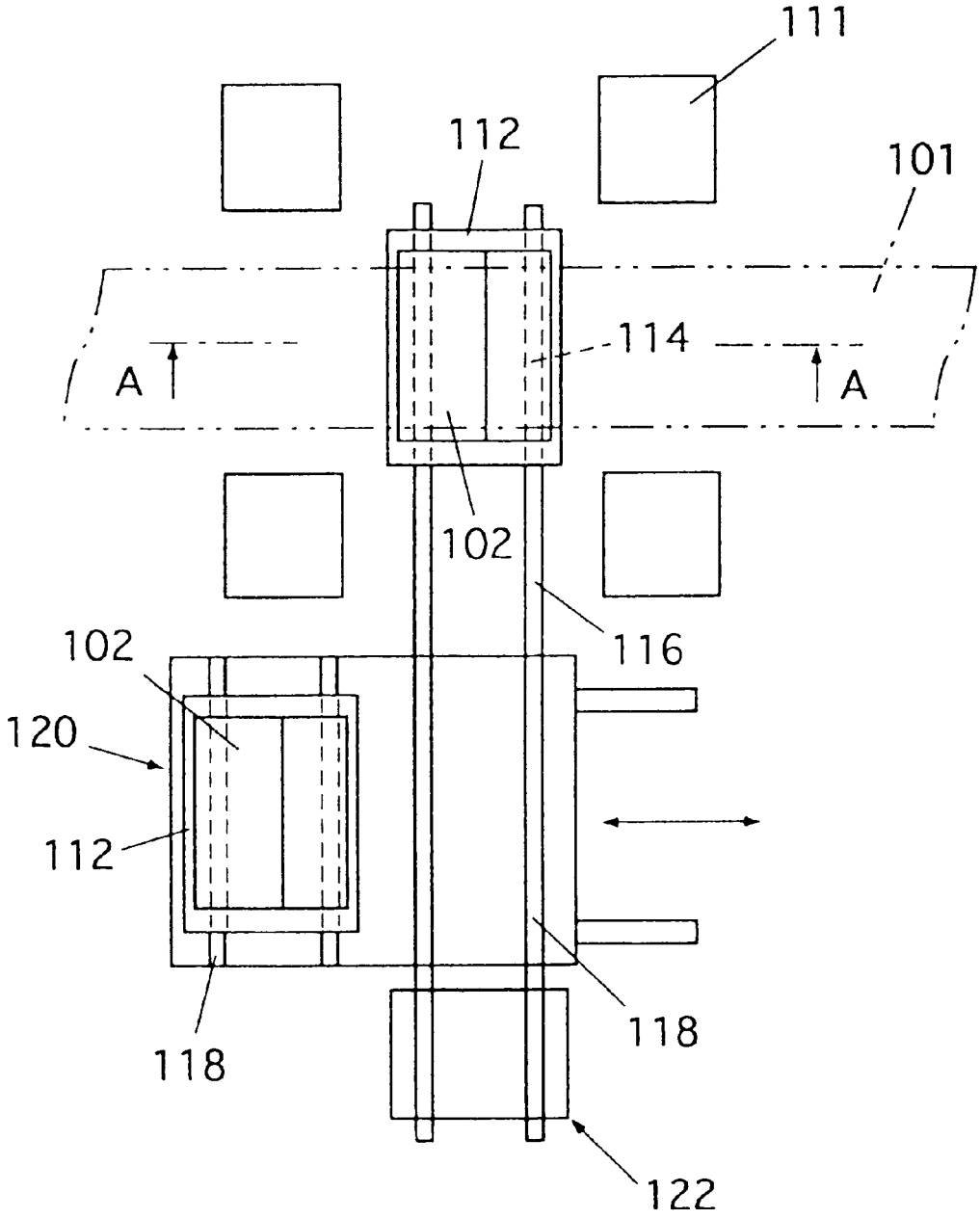
FIG. 14 is a plan view showing the fourth embodiment of the die changing apparatus according to the present invention.
Figure 15:
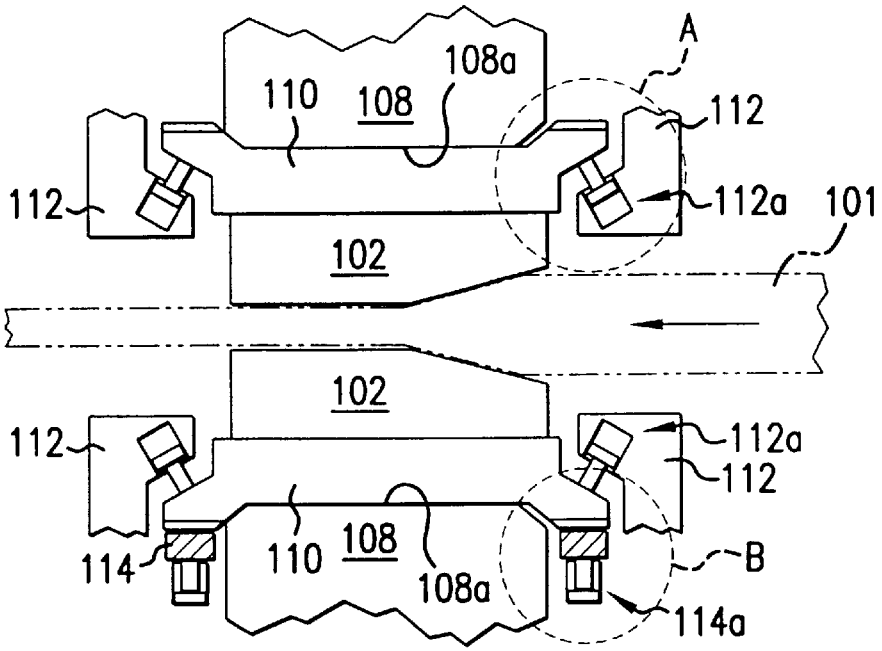
FIG. 15 is a sectional view along the line A—A in FIG. 1, showing the status of the dies during operation.
Figure 16:
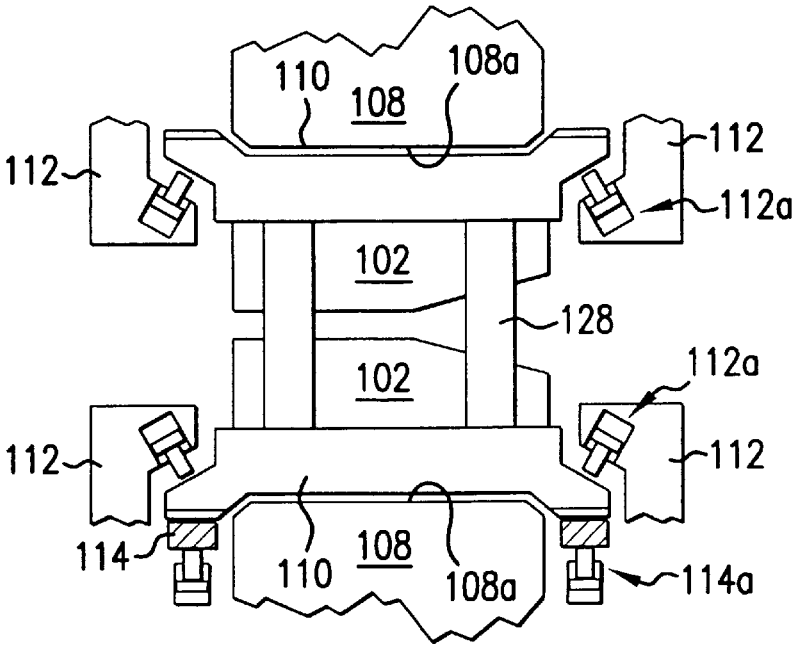
FIG. 16 is a sectional view along the line A—A in FIG. 1, showing the status of the dies during die changing.

FIG. 14 is a plan view showing the fourth embodiments according to the present invention, and FIGS. 15 and 16 are sectional views along the A—A line in FIG. 14. The status of the dies shown in FIGS. 15 and 16 are during operation and during replacement, respectively.

As shown in FIGS. 14 through 16, the die changing apparatus according to the present invention is a die changing apparatus for a plate reduction press that presses the upper and lower dies 102 mounted on the upper and lower sliders 108 and placed vertically opposite each other, towards a slab 101. In FIG. 14, the plate reduction press is represented only by the 4 columns 111.

As shown in FIGS. 15 and 16, the die changing apparatus according to the present invention comprises upper and lower die holders 110 that are fixed to the upper and lower dies 102, respectively, upper and lower die clamps 112 for fixing the die holders 110 in a detachable manner to the sliders 108, and split rails 114 that extend horizontally in the lateral direction (in the direction perpendicular to the paper in this view) of a press line installed beneath the lower die holder 110 and which can be raised and lowered. The upper and lower die clamps 112 are provided with a plurality of clamping cylinders 112*a* (2 cylinders on each of the upper and lower die clamps) that press against the upstream and downstream ends of the die holders 110 (left and right ends in this view) in the press line and put the die holders 110 in close contact with the loading surfaces 108*a* of the upper and lower sliders 108. It is also possible to form the die holders 110 and the die clamps 112 as an integral unit.

In the configuration shown in FIG. 15, the rods of the clamping cylinders 112*a* are extended to push the die holders 110 closely against the loading surfaces 108*a* of the sliders 108, and at the same time the raising/lowering cylinders 114*a* for raising and lowering the split rails 114 are retracted and the supporting surfaces (upper surfaces) of the split rails 114 are separated from the lower die holder 110, thereby the upper and lower die holders 110 with their dies are ready for operation. In this operational state, the reaction forces when a slab 101 is pressed are transmitted from the dies 102 to the sliders 108 through the loading surfaces 108*a*.

On the other hand, as shown in FIG. 16, when there is no slab 101 between the upper and lower die holders 110, spacers 128 are placed between the die holders, the clamping cylinders 112*a* are released (contracted), the die holders 110 are separated from the loading surfaces 108 of the sliders 108 and released from the die clamps, thereby the upper die holder 110 with the upper die can be placed on the lower die holder through the spacers 128. Next, the raising/lowering cylinders 114*a* are extended and the split rails 114 are raised, thus the upper and lower die holders 110 can be supported on the split rails 114 and can slide along the upper surfaces of the rails.

As shown in FIG. 14, the die changing apparatus according to the present invention further comprises changing rails continuing from the split rails 114 with supporting surfaces flush with the supporting surfaces of the raised split rails and extending horizontally outside the press machine, a plurality of shift rails 118 (2 sets in this view) with supporting surfaces flush with the supporting surfaces of the changing rails 116, a sideways shifting apparatus 120 that moves the shift rails 118 in the direction of the press line so that any of the shift rails 118 can be aligned with the changing rails, and a die clamp moving apparatus 122 that slides the upper and lower die holders 110 together with the dies after removal from the die clamps, from the raised split rails 114, to the shift rails 118 via the, changing rails 116.

The sideways shift apparatus 120 comprises a moving base 120*b* with a plurality of shift rails 118 (2 sets in this view) mounted on the upper-surface of the base and guided in the direction of the press line by rails 120*a*, and a moving cylinder (not illustrated) installed underneath the moving base 120*b*. The die clamp moving apparatus 122 comprises a car, cylinder, etc. The shift rails 118 can be installed in either 2 rows (for new and old dies) or 3 rows or more.

According to the die changing methods of the present invention using the aforementioned die changing apparatus, dies are changed using the following steps A through G.

(A) Spacers 128 are placed between the upper and lower die holders 110, clamping cylinders 112*a* are retracted, die holders 110 are separated from the loading surfaces of sliders 108 and released from the die clamps, and at the same time, the upper die holder with the upper die is placed on the lower die holder through the spacers.

(B) Split rails 114 are raised, and the above-mentioned upper and lower die holders are supported by the split rails.

(C) The upper and lower die holders with the dies, after being removed from the die clamps, are moved from the raised split rails to the shift rails via the changing rails, by means of the die clamp moving apparatus 122.

(D) The sideways shift apparatus 120 moves all the shift rails simultaneously in the direction of the press line in such a manner that another pair of shift rails is aligned with the changing rails.

(E) Another set of upper and lower die holders with another set of dies, placed on the second pair of shift rails, are moved to the raised split rails, via the changing rails, by means of the die clamp moving apparatus 122.

(F) The split rails 114 are lowered, and the upper and lower die holders are separated from the split rails.

(G) The clamping cylinders 112*a* are extended, the upper and lower die holders 110 are placed in close contact with the loading surfaces of the upper and lower sliders 108, and the spacers are removed.

According to the aforementioned apparatus and method of the present invention, upper and lower die holders with dies (new and old dies or dies with different dimensions or of different types) placed on a plurality of sets of shift rails 118 can be quickly, easily and automatically replaced using the sideways shift apparatus 120. In addition, old dies (worn or heat-cracked) can be replaced with new dies (unused dies or dies whose surfaces were restructured). Furthermore, dies of different types (corresponding to the thickness of the bar leaving the press, or of different shapes, angles, etc.) can be changed to vary the thickness of the bar leaving the press or to cope with a different type of material. Moreover, two or more dies can be replaced every time several slabs have been pressed, and the dies cooled during the period when they are not in use (when dies are placed outside the press machine), thereby extending the life of the dies.

Figure 17A:
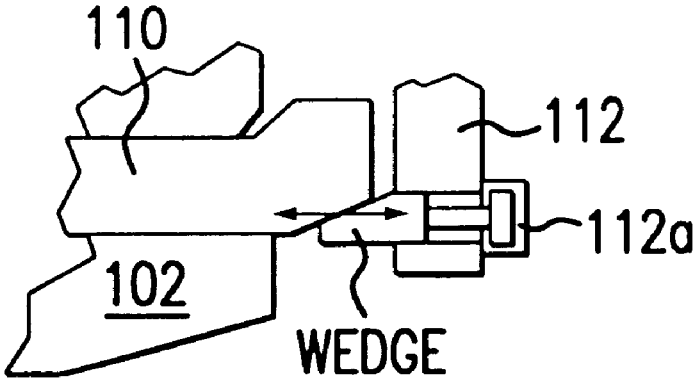
FIG. 17 shows detailed views of parts of FIG. 15 under other operating states.
Figure 17B:
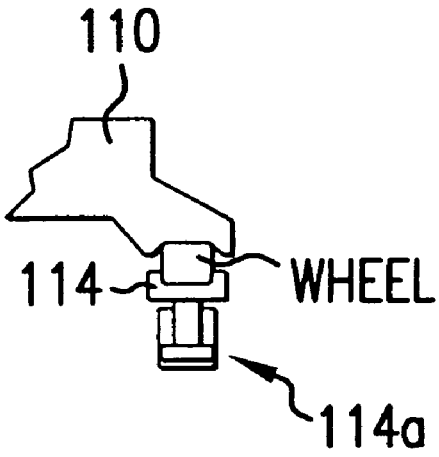

FIG. 17 is a partial view of another example of the embodiment shown in FIG. 15. In FIG. 17, (A) is a view showing another example of the part A in FIG. 15, and (B) shows another example of the part B in FIG. 15.

Another possible configuration is shown in FIG. 17 (A) in which a wedge is moved horizontally by the clamping cylinder 112*a* to keep the die 102 in place. It is also possible that if the above-mentioned sliding part requires a large force to overcome friction when being moved, wheels can be placed between the rail 114 and the die holder 110 to permit a rolling movement instead of sliding, as shown in FIG. 17 (B).

(Fifth embodiment)

Figure 18:
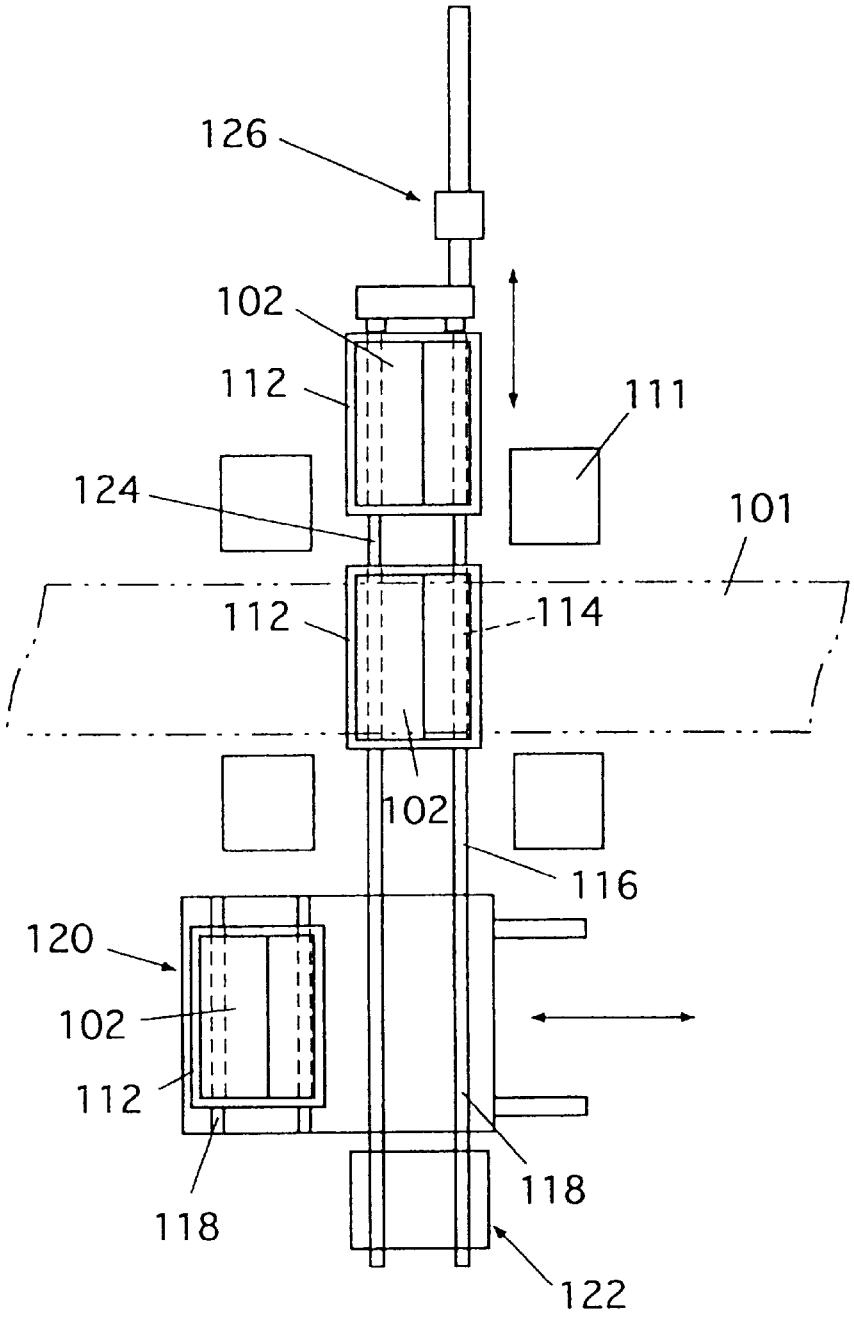
FIG. 18 is a plan view showing the fifth embodiment of the die changing apparatus according to the invention.

FIG. 18 is a plan view showing the fifth embodiment of the die changing apparatus according to the present invention. In FIG. 18, the die changing apparatus based on the present invention comprises changing rails 124 that are a continuation of the split rails 114 on the opposite side to the changing rails 116, with supporting surfaces flush with the supporting surfaces of the raised split rails 114 and extending horizontally outside the press machine, and a die changing clamp moving apparatus 126 that slides the upper and lower die holders with another set of dies, located on the changing rails 114, on to the raised split rails. The die changing clamp moving apparatus 126 can comprise a car, cylinder, ram drive, etc. The other component parts are the same as those of the fourth embodiment shown in FIG. 14.

When dies are replaced according to the present invention using the die changing apparatus shown in FIG. 18, after completing the aforementioned steps A through C, the other upper and lower die holders with another set of dies, located on the changing rails, are slid onto the raised split rails.

Based on the apparatus and the method shown in FIG. 18, replacing dies can be simplified, expedited and automated by using the die changing clamp moving apparatus 26 which can easily and quickly install the upper and lower die holders with another set of dies, located on the changing rails. Hence, the thickness of a bar can be changed, the gap adjusting apparatus of the press machine can be eliminated, different types of dies can be easily changed and used, dies can be cooled externally to prolong their life, and the thickness of a slab can be maintained uniform at a high temperature because the dies are not cooled with water in the press machine (or the flow of water can be reduced).

It should also be noted that the scope of the present invention is not limited only to the embodiments and examples described above, but can be modified in various ways as long as the Claims of the present invention are not changed. For instance, although the fourth and fifth embodiments were explained separately, both of these embodiments can be incorporated together. In the above descriptive paragraphs, sliding movements were mainly described, but it is of course possible to use wheels, etc. for the movements.

As described above, the die changing apparatus and methods for a plate reduction press machine according to the present invention allow the dies in the plate reduction press machine to be replaced easily and quickly, so that the thickness of a bar can be changed, the gap adjusting apparatus of the press machine can be eliminated, different type of dies can be easily replaced and used, dies can be cooled externally and their life can be prolonged, and the dies are not cooled with water in the press machine (or the flow of water can be reduced), therefore the apparatus and the method provides superior advantages such as the capability of maintaining the thickness of a slab evenly at a high temperature.

(First embodiment of split dies)

Figure 19:
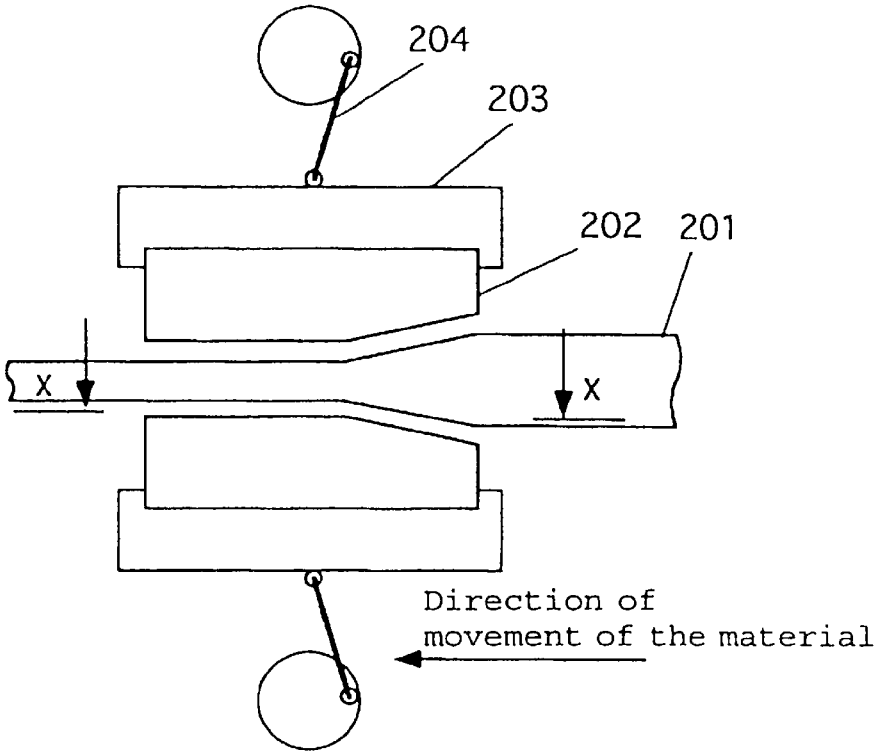
FIG. 19 is a configuration of a reduction press using the split dies according to the present invention.

FIG. 19 is a view showing the configuration of a press machine using the split dies of the first embodiment according to the present invention. The press machine consists of split dies 202 arranged vertically above and below a material 201 to be pressed, die clamps 203 holding the split dies 202 together to form a single body, and a pressing apparatus 204 that applies a pressing load to the split dies 202 via the die clamps 203. Although FIG. 19 schematically shows a crank mechanism as the pressing apparatus 204, another mechanism such as a hydraulic cylinder may also be used.

Figure 20:
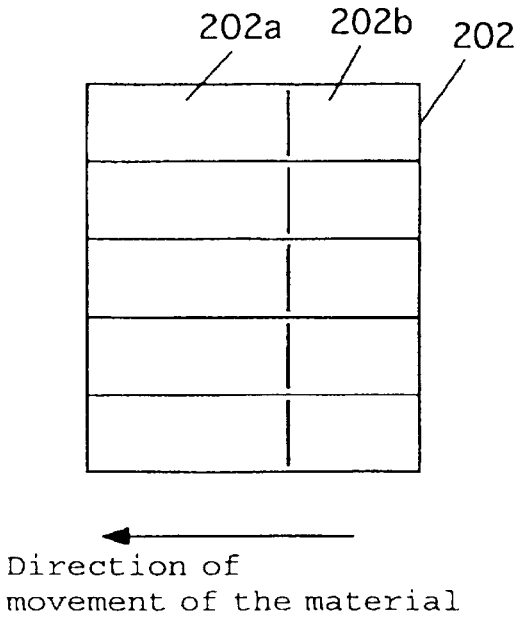
FIG. 20 is a view of FIG. 19 along the line X—X, showing the first embodiment of the split dies.

FIG. 20 is a view in the direction of the arrows X—X in FIG. 19, showing a plan view of the first embodiment of split dies according to the present invention. In FIG. 20, the dies consist of a plurality of split segments 202 arranged closely to each other in the lateral direction of a material 201 to be pressed. In FIG. 20, 5 split segments 202 are shown, but the plurality of split segments can be adjusted appropriately according to the width of the material 201 to be pressed. The planar shape of a split segment 202 in plan view is rectangular, and the surface facing the material 201 to be pressed is configured as a plane 202*a* parallel to the surface of the material 201 and a sloping surface 202b inclined to the surface of the material 201.

Figure 21A:
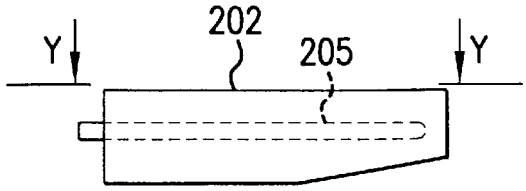
FIG. 21 is a view showing the arrangement of a cooling water passage, constructed in the split dies.
Figure 21B:
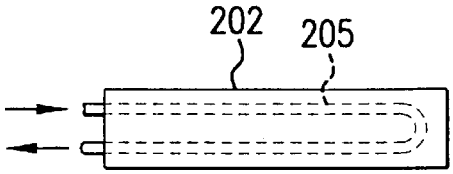
Figure 22A:
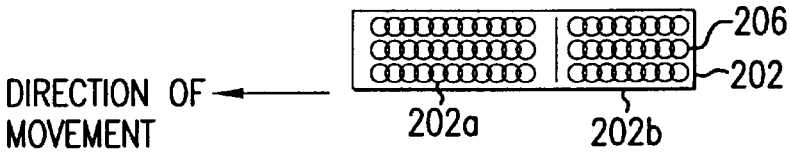
FIG. 22 is a view showing the condition of the split dies when grooves or raised parts are formed in the parallel or sloping surfaces.
Figure 22B:
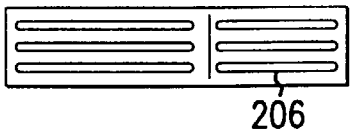
Figure 22C:
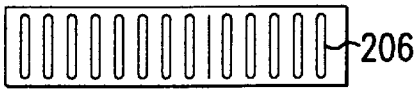
Figure 22D:
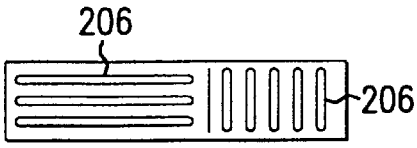
Figure 22E:
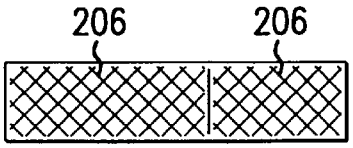
Figure 22F:
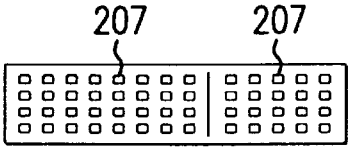

FIG. 21 shows an example of a passage for cooling water, provided in a split die 202. (A) and (B) show a side view and a view in the direction of the arrows Y—Y, respectively. The cooling water passage 205 is constructed inside the split die 202, to pass-cooling water, and a hose not illustrated is connected to supply the cooling water. Thereby, even when a high-temperature slab etc. is to be pressed, the split die 202 can be maintained at a low temperature, so that the life of the split die 202 can be made longer.

FIG. 22 shows grooves 206 or raised parts 207 formed on the parallel and sloping surfaces 202*a*, 202*b* of the split die 202. (A) is concerned with a case in which a plurality of circular grooves 206 partially superimposed on each other, are formed on the parallel and sloping surfaces 202*a*, 202*b*. (B) is a case in which a plurality of straight grooves 206 are formed on the parallel and sloping surfaces 202*a*, 202*b* in the direction of movement of the material 201 to be pressed. (C) represents a case in which a plurality of straight grooves 206 aligned in the direction perpendicular to the direction in which the material 201 to be pressed is moved are formed on the parallel and sloping surfaces 202*a*, 202*b*. In (D), a plurality of straight grooves 206 in the direction of movement of the material 201 to be pressed are formed on the parallel surface 202*a*, and straight grooves 206 in the direction perpendicular to the direction of movement of the material 201 to be pressed are formed on the sloping surface 202*b*. (E) is a case in which a diagonal check pattern of grooves 206 is formed on the parallel and sloping surfaces 202*a*, 202*b*. (F) shows many square raised portions 207 formed on the parallel and sloping surfaces 202*a*, 202*b*. In this manner, by incorporating grooves 206 or raised portions 207, slippage during pressing, between the dies and the material being pressed 201, is reduced. In addition, because the volume of the material being pressed 201 substantially does not change even during pressing, a volume of material proportional to the reduction in thickness, must be displaced (this is called the deformation flow of the material). These grooves 206 or raised portions 207 can control the direction of this deformation flow.

(Second embodiment of split dies)

Figure 23:
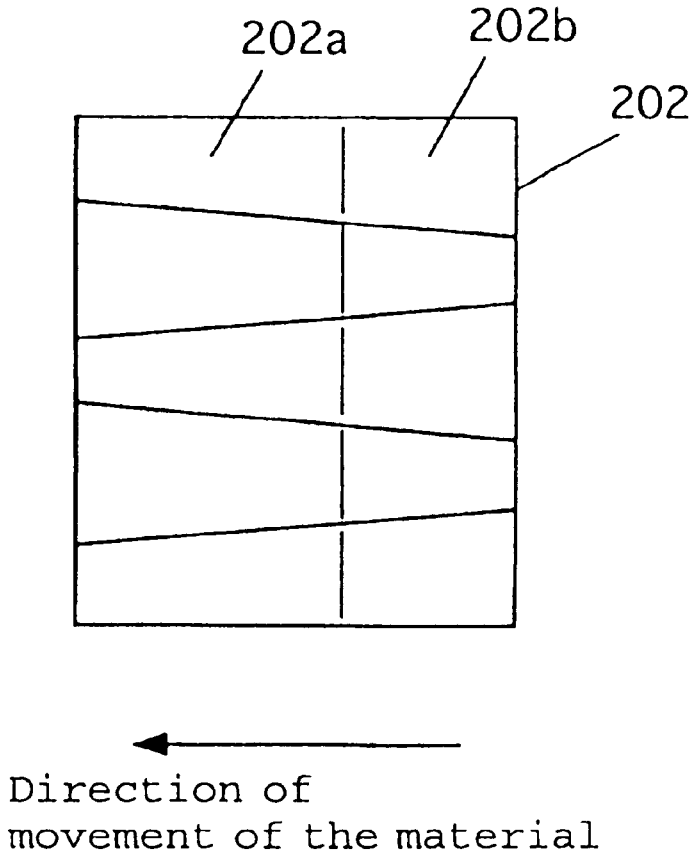
FIG. 23 is a view of FIG. 19 along the line X—X, showing the second embodiment of the split dies.

The second embodiment of split dies according to the present invention is described below. FIG. 23 is a view in the direction of the arrows X—X in FIG. 19 and shows the second embodiment of the split dies 202. With the split dies 202 of this embodiment, the surfaces of a die 202 in contact with adjacent dies are inclined to the direction of movement (longitudinal direction) of the material 201 to be pressed, and this is a difference from the split dies 202 of the first embodiment shown in FIG. 20. The cooling water passages 205 shown in FIG. 21 are provided also in the split dies 202 of the second embodiment of the present invention, on which the grooves 206 or raised portions 207 shown in FIG. 22 are constructed on either or both the parallel and sloping surfaces 202*a*, 202*b*. As the surfaces of a die in contact with adjacent dies 202 are skewed in this way, stripes that may be produced longitudinally in the material 201 to be pressed when it is being pressed, can be reduced.

Obviously from the foregoing descriptions, the present invention offers the following advantages.

1) By dividing dies in the lateral direction of the material 201 to be pressed, cracks and deformation of the dies can be suppressed. When dies wear, it is possible to replace only the split dies in the center which have the greatest wear. In addition, the plurality of split dies to be used can be varied depending on the width of the material 201 to be pressed, so the plurality. of dies to be prepared can be reduced compared to when dies have to be prepared for all widths of materials to be pressed 201. Moreover, split dies can be manufactured more easily at a lower cost.
2) By making the contact surfaces of a split die in contact with the adjacent split dies inclined to the longitudinal direction of the transfer line, longitudinal stripes produced when a material 201 to be pressed is pressed, can be reduced.
3) By cooling split dies with cooling water through internal passages, the life of the dies can be prolonged.
4) By constructing grooves 206 or raised portions 207 on the parallel and sloping surfaces of dies, slippage between the material being pressed 201 and the dies can be reduced. In addition, the direction of the deformation flow of the material being pressed 201 can be controlled to a preferred direction.

The present invention has been described referring to several preferred embodiments, but it should be understood that the scope of the rights claimed in the present invention is not limited to these embodiments. Conversely, the scope of the claims of the present invention should include all modifications, corrections or the like to be included in the scope of the attached claims.

What is claimed is:

1. A die changing apparatus for a plate reduction press machine on a transfer line, comprising:

an upper die support holder disposed above the transfer line;

a lower die support holder vertically displaced from the upper die support holder and on an opposite of the transfer line from the upper die support holder;

support holder guide rails fixed to the upper die support holder and extending horizontally in a direction lateral to the transfer line, an upper die equipped with die rollers rollable along the guide rails, wherein the upper die is mounted on the upper die support holder by the die rollers;

a first fixing device having a first position fixing the upper die to the upper die support holder and a second position releasing the upper die from the upper die holder;

a lower die mounted on the lower die support holders;

a second fixing device having a first position fixing the lower die to the lower die support holder and a second position releasing the lower die from the lower die holder;

die fastening members arranged opposite each other on each side of the upper and lower dies connectable to each of the upper and lower dies; and a die changing mechanism moving one of the die fastening members horizontally in the the direction lateral of the transfer line.

2. The die changing apparatus specified in claim 1, wherein the die changing mechanism further comprises:

a rack having external guide rails having a position correctly opposite the support holder guide rails alongside the transfer line wherein the die rollers are rollable and movable thereon;

a moving member having moving-member rollers having a position wherein the moving member rollers are rollable and movable on the external guide rails, the moving member being mounted on the rack by the moving-member rollers;

an actuator having a direction of travel moving the moving-member in the lateral direction of the transfer line; and a connecting member that is fixed to the moving member and having a position connected to one of the die fastening members.

3. The die changing apparatus specified in claim 2, further comprising a plurality of the die changing mechanisms mounted on a turntable located alongside the transfer line in such a manner that the external guide rails of each die changing mechanism have respective positions correctly opposite the support holder guide rails when the turntable rotates.

4. The die changing apparatus specified in claim 2, comprising a plurality of the die changing mechanisms mounted on a cart arranged alongside the transfer line that can be moved along a direction along the transfer line so that the external guide rails of each die changing mechanism have respective positions correctly opposite the support holder guide rails when the cart in moved.

5. The die changing mechanism specified in claim 1, further comprising a rack having external guide rails having respective positions correctly opposite the support holder guide rails alongside the transfer line wherein the die rollers are rollable and movable thereon, a pulling rope having one end engagable with a die fastening member on one side of the transfer line and another end engagable with the other die fastening member on the other side of the transfer line, and a winch having two configurations each configuration pulling the pulling rope towards one side of the transfer line as selected.

6. The die changing apparatus specified in claim 5, comprising two racks arranged on opposite sides of the transfer line wherein the external guide rails of each rack have respective positions correctly opposite the support holder guide rails.

7. A die changing apparatus for a plate reduction press machine having a transfer line for transferring a slab through the machine, the machine having upper and lower sliders movable in a direction of a thickness of the slab and disposed to press upper and lower dies located vertically on opposite sides of the slab onto the slab, the die changing apparatus comprising:

upper and lower die clamps having first and second positions fixing the upper and lower dies to the upper and lower sliders, and releasing the upper and lower dies from the upper and lower sliders, respectively;

split rails installed below a lower portion of the lower die holder having a first raised position in contact with the lower die holder and a second lowered position out of contact with the lower die holder, the split rails extending horizontally in a lateral direction of the transfer line;

die changing rails in a continuous line with the split rails, the die changing rails having support surfaces flush with the support surfaces of the split rails when the split rails are in the first raised position, wherein the die changing rails extend outside the reduction press machine;

a plurality of shift rails having support surfaces flush with the support surfaces of the changing rails;

a sideways shift apparatus for moving the shift rails in a direction along the press line so that one pair of shift rails is aligned with the changing rails; and a die clamp moving apparatus moving the upper and lower die holders with the dies, after being removed from the die clamps, from the raised split rails, to the shift rails through the changing rails.

8. The die changing apparatus specified in claim 7, further comprising rails extending horizontally outside the reduction press machine on an opposite side to the changing rails, the rails having support surfaces flush with the support surfaces of the raised split rails, in a continuous line with the split rails, and a die change clamp moving apparatus that moves upper and lower die holders with another set of dies, which have been placed on the changing rails, on to the raised split rails.

9. The die changing apparatus according to claim 7, wherein the upper and lower die clamps further comprise a plurality of clamping cylinders that push against upstream and downstream ends of the die holders in the transfer line to fix the upper and lower dies, respectively, on to the loading surfaces of the upper and lower sliders.

10. In a method of changing dies for a plate reduction press machine having a transfer line for transferring a slab through the machine, comprising the steps of: providing upper and lower dies arranged vertically on opposite sides of a slab; and providing upper and lower sliders that press the slab by an upwards and downwards, forwards and backwards motion;

a method of changing dies for a plate reduction press machine, further comprising the steps of:

providing upper and lower die holders for fixing the upper and lower dies, respectively;

providing upper and lower die clamps for fixing the die holders in a detachable manner;

providing split rails installed on a lower portion of the lower die holder, and extending horizontally in the lateral direction of the transfer line, the split rails having a first raised position in contact with the lower die holder and a second lowered position out of contact with the lower die holder, providing changing rails continuing from the split rails, extending horizontally outside the reduction press machine, the changing rails having support surfaces flush with the support surfaces of the changing rails, providing a plurality of shift rails with support surfaces flush with the support surfaces of the changing rails, providing a sideways shift apparatus that moves in the direction of the transfer line so that one pair of the shift rails is aligned with the changing rails, and providing a die clamp moving apparatus that moves the upper and lower die holders with the dies, after being removed from the die clamps, from the raised split rails, to the shift rails through the changing rails, in which the upper and lower clamps comprise a plurality of clamping cylinders (112*a*) that push against upstream and downstream ends of the die holders (110) in the transfer line and make the die holders come into close contact with the loading surfaces of the upper and lower sliders (108);

(A) placing a spacer between the upper and lower die holders, releasing the clamping cylinders, separating the die holders from loading surfaces of the sliders and removing the die holders from the die clamps, and, simultaneously, placing the upper die holder with the upper die on the lower die holder via the spacer;

(B) raising the split rails, and resting the upper and lower die holders on the split rails; and (C) moving the upper and lower die holders with the dies, after being removed from the die clamps, from the raised split rails to the shift rails via the changing rails, by means of the die clamp moving apparatus.

11. The method of changing dies for a plate reduction press machine, specified in claim 10, further comprising the steps, continuing from (A), (B) and (C) of:

(D) moving the plurality of shift rails simultaneously in the direction of the press line with the sideways apparatus in such a manner that another pair of shift rails are aligned with the changing rails;

(E) moving another set of upper and lower die holders with other dies, placed on another pair of shift rails, to the raised shift rails, via the changing rails, with the die clamp moving apparatus, (F) lowering the split rails, and separating the upper and lower die holders from the split rails, and (G) extending the clamping cylinders, placing the upper and lower die holders in close contact with loading surfaces of the upper and lower sliders, and removing the spacer.

12. The method of changing dies for a plate reduction press machine, specified in claim 10, further comprising the steps of:

providing changing rails extending horizontally outside the reduction press machine, in a continuous line with the split rails, on the opposite side to the changing rails, with support surfaces flush with the support surfaces of the raised split rails, and a die change clamp moving apparatus for moving another set of upper and lower die holders with dies, placed on the changing rails, on to the raised split rails; and wherein the die change clamp moving apparatus moves the other upper and lower die holders with dies, placed on the changing rails, on to the raised split rails.

* * * * *